US009005861B2

(12) United States Patent
Fukushima et al.

(10) Patent No.: US 9,005,861 B2
(45) Date of Patent: Apr. 14, 2015

(54) ELECTROSTATIC LATENT IMAGE DEVELOPER, DEVELOPING APPARATUS, IMAGE FORMING APPARATUS AND IMAGE FORMING METHOD

(75) Inventors: Norihito Fukushima, Minamiashigara (JP); Manabu Serizawa, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/550,134

(22) Filed: Jul. 16, 2012

(65) Prior Publication Data

US 2013/0260296 A1 Oct. 3, 2013

(30) Foreign Application Priority Data

Mar. 27, 2012 (JP) ..... 2012-071900

(51) Int. Cl.

| | |
|---|---|
| ***G03G 9/00*** | (2006.01) |
| ***G03G 9/08*** | (2006.01) |
| ***G03G 9/087*** | (2006.01) |
| ***G03G 9/113*** | (2006.01) |

(52) U.S. Cl.

CPC ..... *G03G 9/08755* (2013.01); *G03G 9/0806* (2013.01); *G03G 9/08711* (2013.01); *G03G 9/1135* (2013.01)

(58) Field of Classification Search

USPC ..... 430/109.1, 109.3, 109.4, 111.1, 111.3, 430/111.31, 111.35

See application file for complete search history.

(56) References Cited

U.S. PATENT DOCUMENTS

| | | | | |
|---|---|---|---|---|
| 8,512,926 | B2 * | 8/2013 | Daimon et al. | 430/109.1 |
| 2006/0292477 | A1 * | 12/2006 | Daimon et al. | 430/109.4 |
| 2008/0056769 | A1 * | 3/2008 | Iizuka et al. | 399/252 |
| 2009/0011347 | A1 * | 1/2009 | Daimon et al. | 430/48 |
| 2010/0151377 | A1 | 6/2010 | Uchino et al. | |
| 2011/0212398 | A1 * | 9/2011 | Hayashi et al. | 430/109.3 |
| 2011/0236814 | A1 | 9/2011 | Fukushima et al. | |
| 2012/0021352 | A1 | 1/2012 | Matsubara et al. | |

FOREIGN PATENT DOCUMENTS

| | | | |
|---|---|---|---|
| EP | 1 293 840 | A1 | 3/2003 |
| EP | 2 362 270 | A2 | 8/2011 |
| JP | A-03-203743 | | 9/1991 |
| JP | A-05-107816 | | 4/1993 |
| JP | A-2007-322613 | | 12/2007 |
| JP | 2008122444 | A * | 5/2008 |
| JP | A-2010-060768 | | 3/2010 |
| JP | A-2010-164962 | | 7/2010 |

(Continued)

OTHER PUBLICATIONS

English Translation of JP-2008122444A.*

(Continued)

*Primary Examiner* — Stewart Fraser
(74) *Attorney, Agent, or Firm* — Oliff PLC

(57) ABSTRACT

An electrostatic latent image developer contains: an electrostatic-latent-image-developing toner that has toner particles formed by aggregating and fusing particles of a polyester resin, particles of a styrene resin and particles of a coloring agent in a starting material dispersion liquid of those particles dispersed in an aqueous solvent; and a carrier having a core particle and a resin coating layer to coat the surface of the core particle, wherein the ratio of the exposed area of the core particle to the surface of the carrier is about 7% or less.

12 Claims, 2 Drawing Sheets

(56) References Cited

FOREIGN PATENT DOCUMENTS

| | | |
|---|---|---|
| JP | A-2011-145321 | 7/2011 |
| JP | A-2011-145587 | 7/2011 |
| JP | A-2011-149986 | 8/2011 |
| JP | A-2011-185973 | 9/2011 |

OTHER PUBLICATIONS

Aug. 1, 2013 Extended European Search Report issued in European Patent Application No. 12179176.8.

* cited by examiner

ELECTROSTATIC LATENT IMAGE DEVELOPER, DEVELOPING APPARATUS, IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2012-071900 filed on Mar. 27, 2012.

BACKGROUND

Technical Field

The present invention relates to an electrostatic latent image developer, a developing apparatus, an image forming apparatus and an image forming method.

SUMMARY

According to an aspect of the invention, there is provided an electrostatic latent image developer containing:

an electrostatic-latent-image-developing toner that has toner particles formed by aggregating and fusing particles of a polyester resin, particles of a styrene resin and particles of a coloring agent in a starting material dispersion liquid of those particles dispersed in an aqueous solvent; and a carrier having a core particle and a resin coating layer to coat the surface of the core particle, wherein the ratio of the exposed area of the core particle to the surface of the carrier is about 7% or less.

BRIEF DESCRIPTION OF THE DRAWINGS

FIG. 2 is a schematic configuration diagram illustrating an image forming apparatus according to another exemplary embodiment of the invention, wherein

1 denotes Subbing Layer, 2 denotes Charge Generation layer, 3 denotes Charge Transport Layer, 4 denotes Electroconductive Substrate, 5 denotes Protective layer, 6 denotes Single-Layered Photosensitive Layer, 7A, 7B, 7C, 7D denotes Electrophotographic Photoreceptor, 10 denotes Electrophotographic Photoreceptor, 20 denotes Charging Device, 30 denotes Exposure Device, 40 denotes Developing Device, 41 denotes Developer Tank, 41A denotes Developer Tank Body, 41B denotes Developer Tank Cover, 41C denotes Partition Wall, 42 denotes Developing Roller, 42A denotes Developing Roller Chamber, 43 denotes Stirring Member, 43A denotes Stirring Chamber, 44 denotes Stirring Member, 44A denotes Stirring Chamber, 45 denotes Control Member, 50 denotes Intermediate Transfer Body, 50A denotes Supporting Roller, 50B denotes Supporting Roller, 50C denotes Backside Roller, 50D denotes Driving Roller, 51 denotes Primary Transfer Device, 52 denotes Secondary Transfer Device, 53 denotes Recording Paper Supply Device, 53A denotes Conveying Roller, 53B denotes Guide Plate, 54 denotes Intermediate Transfer Cleaning Device, 70 denotes Cleaning Device, 71 denotes Casing, 72 denotes Cleaning Blade, 80 denotes Fixing Device, 81 denotes Fixing Roller, 82 denotes Conveying Rotor, 101 denotes Image Forming Apparatus, 101A denotes Process Cartridge.

DETAILED DESCRIPTION

Exemplary embodiments of the invention will be described in detail hereinunder with reference to the drawings attached hereto.

Figure 1:
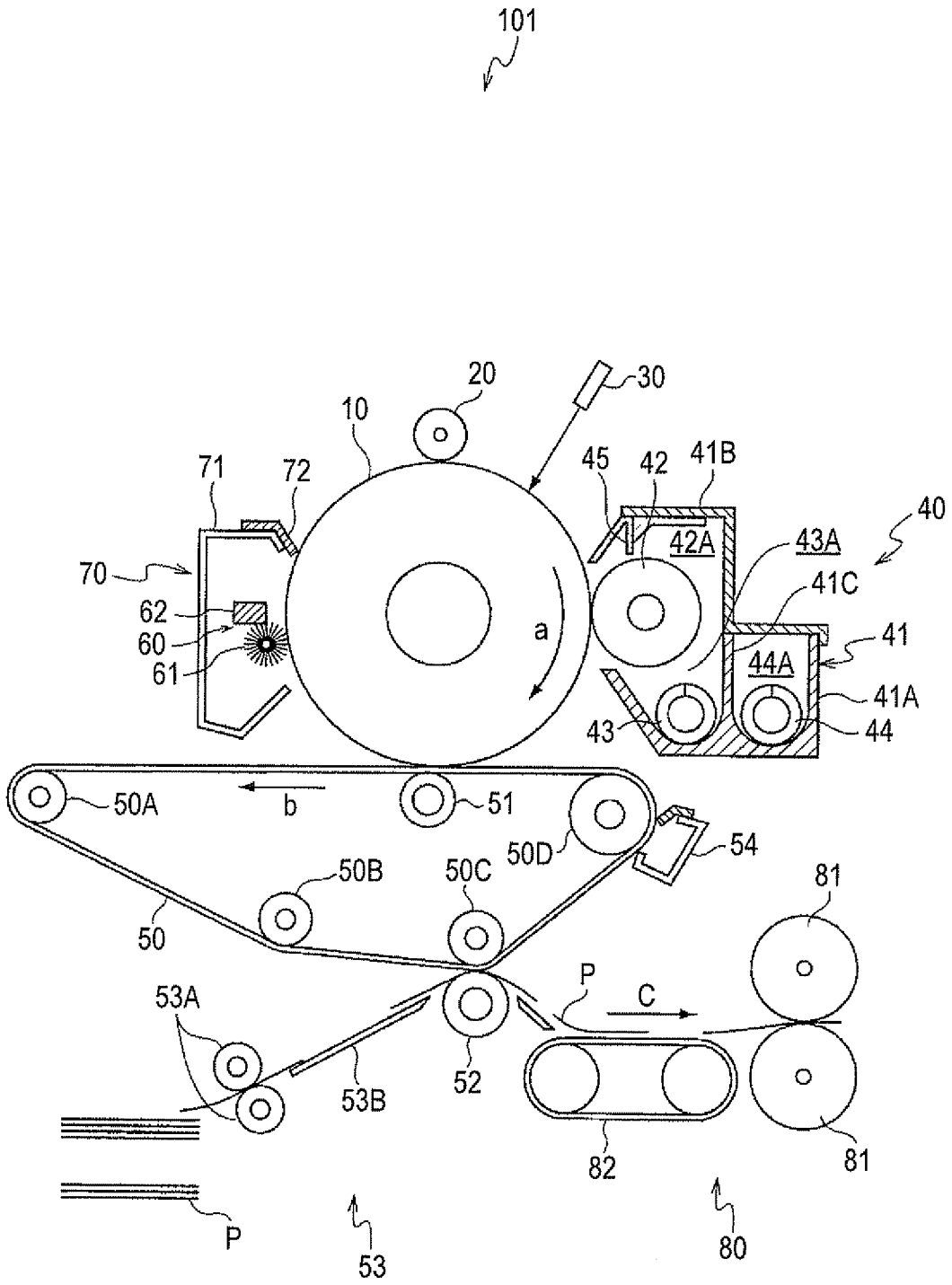
FIG. 1 is a schematic configuration diagram illustrating an image forming apparatus according to an exemplary embodiment of the invention.

FIG. 1 is a schematic configuration diagram illustrating one example of an image forming apparatus according to an exemplary embodiment of the invention.

As shown in FIG. 1, the image forming apparatus 101 according to the exemplary embodiment of the invention is equipped with an electrophotographic photoreceptor 10 (one example of an image holding member) that rotates in the clockwise direction, as indicated by an arrow a; a charging device 20 (one example of a charging unit) that is provided on the upper side of the electrophotographic photoreceptor 10 so as to face the electrophotographic photoreceptor 10 and charges the surface of the electrophotographic photoreceptor 10; an exposure device 30 (one example of a latent image forming unit) that exposes the surface of the electrophotographic photoreceptor 10 which is charged by the charging device 20, to form an electrostatic latent image; a developing device 40 (one example of a developing unit) that holds therein a toner-containing electrostatic image developer to develop the electrostatic latent image formed on the electrophotographic photoreceptor 10 to be a toner image; a belt-shaped intermediate transfer body 50 that runs along the direction indicated by an arrow b, while being in contact with the electrophotographic photoreceptor 10 and transfers thereonto the toner image formed on the surface of the electrophotographic photoreceptor 10; and a cleaning device 70 that cleans the surface of the electrophotographic photoreceptor 10.

The charging device 20, the exposure device 30, the developing device 40, the intermediate transfer body 50, the lubricant supply device 60, and the cleaning device 70 are arranged on the circumference surrounding the electrophotographic photoreceptor 10 in the clockwise direction. In the exemplary embodiment of the invention, a configuration in which the lubricant supply device 60 is arranged inside the cleaning device 70 is explained; however, the invention is not limited thereto. A configuration in which the lubricant supply device 60 is arranged apart from the cleaning device 70 may be also adopted. Needless-to-say, a configuration in which the cleaning device 70 and the lubricant supply device 60 are not arranged is also employable here.

The intermediate transfer body 50 is held, from the inside thereof, by supporting rollers 50A and 50B, a backside roller 50C, and a driving roller 50D, while applying tension to the intermediate transfer body, and is driven in the direction indicated by the arrow b, accompanying the rotation of the driving roller 50D. A primary transferring device 51 is disposed on the inside of the intermediate transfer body 50 at the position facing the electrophotographic photoreceptor 10. The primary transferring device 51 charges the intermediate transfer body 50 so as to have a polarity different from the charge polarity of the toner, and makes the toner on the electrophotographic photoreceptor 10 adhere to the outer surface of the intermediate transfer body 50. A secondary transferring device 52 is disposed on the outside of the intermediate transfer body 50 in the lower position thereof, at the position opposing the backside roller 50C. The secondary transferring device 52 charges the recording paper P (one example of a recording medium) so as to have a polarity different from the charge polarity of the toner, and transfers the toner image formed on the intermediate transfer body 50 onto the recording paper P. Note that, these members which are used for transferring the toner image formed on the electrophotographic photoreceptor 10 onto the recording paper P correspond to one example of the transfer unit.

Further, on a lower side of the intermediate transfer body 50, a recording paper supply device 53 that supplies the recoding paper P to the secondary transferring device 52, and a fixing device 80 that fixes the toner image while conveying the recoding paper P, on which the toner image has been formed in the secondary transferring device 52, are provided.

The recording paper supply device 53 is equipped with a pair of conveying rollers 53A and a guide board 53B that guides the recording paper P conveyed by the conveying rollers 53A toward the secondary transferring device 52. On the other hand, the fixing device 80 has fixing rollers 81, which are a pair of heat rollers that perform fixation of the toner image by heating and pressing the recording paper P onto which the toner image has been transferred by the secondary transferring device 52, and a conveying rotor 82 that conveys the recording paper P toward the fixing rollers 81.

The recording paper P is conveyed in the direction indicated by an arrow c by the recording paper supply device 53, the secondary transferring device 52, and the fixing device 80.

The intermediate transfer body 50 further includes an intermediate transfer body cleaning device 54. The intermediate transfer body cleaning device 54 has a cleaning blade that removes the toner remaining on the intermediate transfer body 50, after the toner image has been transferred to the recording paper P in the secondary transferring device 52.

Hereinafter, the main constituent members in the image forming apparatus 101 according to the exemplary embodiment of the invention are described in detail.

[Electrostatic Latent Image Developer]

The electrostatic latent image developer of the exemplary embodiment of the invention (hereinafter this may be referred to as the developer) is a two-component developer containing an electrostatic-latent-image-developing toner (hereinafter this may be referred to as a toner) and a carrier.

The developer of the exemplary embodiment of the invention is described in detail hereinunder.

(Electrostatic-Latent-Image-Developing Toner)

The toner may contain, for example, toner particles and an optionally external additive.

—Toner Particles—

The toner particles may contain a binder resin, a coloring agent and optionally a release agent and any other components.

First described is the binder resin.

As the binder resin, a polyester resin and a styrene resin are used.

The polyester resin includes mainly those produced through polycondensation of a polycarboxylic acid and a polyalcohol. The polyester resin may be a single polyester resin alone or a mixture of two or more different types of polyester resins.

The polycarboxylic acid is not specifically defined, for which, for example, usable here are monomer components described in heretofore-known di- or more polycarboxylic acids.

Of the polycarboxylic acids, dicarboxylic acids include, for example, dibasic acids such as alkylsuccinic acid, alkenylsuccinic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, mesaconic acid, etc., and their anhydrides and lower alkyl esters, as well as aliphatic unsaturated dicarboxylic acids such as maleic acid, fumaric acid, itaconic acid, citraconic acid, etc.

The alkylsuccinic acid and alkenylsuccinic acid include, for example, n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid, etc.

Of the polycarboxylic acids, tri or more polycarboxylic acids include, for example, 1,2,4-benzenetricarboxylic acid (trimellitic acid), 1,2,5-benzenetricarboxylic acid, 1,2,4-naphthalenetricarboxylic acid, and their anhydrides and lower alkyl esters, etc.

One or more different types of those polycarboxylic acids may be used here either singly or as combined.

As the polycarboxylic acid, especially preferred are adipic acid, alkenylsuccinic acid and terephthalic acid; and more preferred are alkenylsuccinic acid and terephthalic acid.

The polyalcohol is not specifically defined, for which, for example, usable here are monomer components described in heretofore-known di- or more polyalcohols.

Examples of polyalcohols include, for example, aliphatic dials such as ethylene glycol, diethylene glycol, triethylene glycol, propylene glycol, butanediol, hexanediol, neopentyl glycol, glycerin, etc.; alicyclic diols such as cyclohexanediol, cyclohexanedimethanol, hydrogenated bisphenol A, etc.; aromatic diols such as bisphenol A ethylene oxide adduct, bisphenol A propylene oxide adduct, etc.

Of the polyalcohols, tri or more polyalcohols include, for example, glycerin, trimethylolethane, trimethylolpropane, pentaerythritol, etc.

One or more such polyalcohols may be used here either singly or as combined.

In particular, bisphenol A is preferred as the polyalcohol; and concretely, bisphenol A alkylene oxide adducts (bisphenol A ethylene oxide adduct, bisphenol A propylene oxide adduct, etc.) are preferred.

The weight-average molecular weight (Mw) of the polyester resin is, for example, within a range of from 12000 to 200000 or from about 12000 to about 200000, and may be within a range of from 14000 to 140000 or from about 14000 to about 140000, or within a range of from 16000 to 120000 or from about 16000 to about 120000.

The number-average molecular weight (Mn) of the polyester resin is, for example, within a range of from 4000 to 20000, and may be within a range of from 5000 to 12000.

The molecular weight distribution of the polyester resin may be within a range of from 2 to 15 in terms of the value of Mw/Mn that is the index of the molecular weight distribution thereof.

The glass transition temperature of the polyester resin is, for example, within a range of from 30° C. to 90° C. or from about 30° C. to about 90° C., and may be within a range of from 30° C. to 80° C. or from about 30° C. to about 80° C., or within a range of from 50° C. to 70° C. or from about 50° C. to about 70° C.

Not specifically defined, the styrene resin may be any resin of a homopolymer of styrene or a styrene derivative, or a copolymer of styrene or a styrene derivative with any other monomer. It is not particularly limited as long as it is within such a resin.

The styrene derivative includes alkyl-substituted styrenes having an alkyl chain, such as α-methylstyrene, 4-methylstyrene, vinylnaphthalene, 2-methylstyrene, 3-methylstyrene, 2-ethylstyrene, 3-ethylstyrene, 4-ethylstyrene, etc.; halogen-substituted styrenes such as 2-chlorostyrene, 3-chlorostyrene, 4-chlorostyrene, etc.; fluorine-substituted styrenes such as 4-fluorostyrene, 2,5-difluorostyrene, etc.

The other monomer includes, for example, (meth)acrylic acid, (meth)acrylates such as n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth) acrylate, n-tetradecyl (meth)acrylate, n-hexadecyl (meth) acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, etc.; as well as acrylonitrile, olefins (ethylene, butadiene), maleic acid, maleic anhydride, etc.

The styrene resin includes various known materials, concretely for example, polystyrene, styrene-alkyl acrylate copolymer, styrene-alkyl methacrylate copolymer, styrene-acrylonitrile copolymer, styrene-butadiene copolymer, styrene-maleic anhydride copolymer, etc. Of those, preferred are styrene-alkyl acrylate copolymers; and more preferred is styrene-n-butyl acrylate copolymer.

Preferably, styrene or the styrene derivative is contained in an amount of from 30% by mass to 95% by mass relative to all the polymerization components in the styrene resin, more preferably from 60% by mass to 85% by mass.

Preferably, the styrene resin for use herein has a weight-average molecular weight Mw of from 20,000 to 100,000, and has a number-average molecular weight of from 2,000 to 30,000.

The molecular weight of each resin and the toner (Mn, Mw) is measured with Tosoh's GPC, HLC8120GPC.

The glass transition temperature (Tg) is measured as the extrapolation glass transition initiating temperature according to HS K 7121-1987 (method for measurement of transition temperature of plastics) using Shimadzu's DSC, DSC60.

The total content of the polyester resin and styrene resin, as the binder resin, is, for example, within a range of from 70% by mass to 95% by mass or from about 70% by mass to about 95% by mass, relative to the entire toner particles, and may be within a range of from 80% by mass to 95% by mass or from about 80% by mass to about 95% by mass.

The ratio by mass of the polyester resin to the styrene resin (polyester resin/styrene resin) may be from 10/90 to 50/50 or from about 10/90 to about 50/50, but preferably from 15/85 to 40/60 or from about 15/85 to about 40/60, more preferably from 20/80 to 30/70 or from about 20/80 to about 30/70.

The coloring agent includes known organic or inorganic pigments or dyes, or oil-soluble dyes.

For example, as black pigment, there are mentioned carbon black, magnetic powder, etc.

As yellow pigment, for example, there are mentioned Hansa Yellow, Hansa Yellow 10G, Benzidine Yellow G, Benzidine Yellow GR, Surene Yellow, quinoline yellow, permanent yellow NCG, C.I. Pigment Yellow 74, etc.

As red pigment, there are mentioned red iron oxide, Watchung Red, permanent red 4R, Lithol Red, Brilliant Carmine 313, Brilliant Carmine 6B, DuPont Oil Red, Pyrazolone Red, Rhodamine B Lake, Lake Red C, rose Bengal, eoxin red, alizarin lake, etc.

As blue pigment, there are mentioned iron blue, cobalt blue, alkali blue lake, Victoria blue lake, fast sky blue, indanthrene blue BC, aniline blue, ultramarine blue, Calco oil blue, methylene blue chloride, phthalocyanine blue, phthalocyanine green, malachite green oxalate, etc.

As the coloring agent, preferred is use of C.I. Pigment Yellow 74.

These coloring agents may be mixed for use herein, or may be used here in the form of a solid solution thereof.

The content of the coloring agent may be, for example, within a range of from 2% by mass to 15% by mass of the components constituting the toner particles, but is preferably within a range of from 3% by mass to 10% by mass.

Not specifically defined, the release agent includes, for example, petroleum wax, mineral wax, plant and animal wax, as well as synthetic wax such as polyolefin wax, polyolefin wax oxide, Fischer-Tropsch wax, etc. The melting temperature of the release agent may be, for example from 40° C. to 150° C., but is preferably from 50° C. to 120° C.

The content of the release agent may be, for example, within a range of from 1% by mass to 10% by mass of the components constituting the toner particles, but is preferably within a range of from 2% by mass to 8% by mass.

As the other components, for example, there are mentioned various components such as internal additive, charge-controlling agent, inorganic powder (inorganic particles), etc.

The internal additive includes, for example, magnetic substances such as ferrite, magnetite, reduced iron, cobalt, nickel, manganese or the like metals, alloys and compounds containing these metals, etc.

As the charge-controlling agent, for example, usable here are compounds selected from a group consisting of metal salts of benzoic acid, metal salts of salicylic acid, metal salts of alkylsalicylic acid, metal salts of catechol, metal-containing bisazo dyes, tetraphenylborate derivatives, quaternary ammonium salts, alkylpyridiniums salts, etc.; as well as polar group-containing resin-type charge-controlling agents, etc.

As the inorganic particles for use herein, there are mentioned known inorganic particles such as silica particles, titanium oxide particles, alumina particles, cerium oxide particles, and particles prepared by hydrophobizing the surfaces of those particles. The inorganic particles may be processed for various surface treatment, and may be surface-treated with, for example, a silane-based coupling agent, a titanium-based coupling agent, silicone oil, etc.

The volume-average particle diameter of the toner particles and the toner may be, for example, from 2.0 μm to 10 μm, but is preferably from 4.0 μm to 8.0 μm.

The volume-average particle diameter of the toner particles and the toner may be measured, for example, according to the method mentioned below.

First, from 0.5 mg to 50 mg of the sample to be analyzed is put into 2 ml of an aqueous 5 mass % solution of a surfactant, preferably sodium alkylbenzenesulfonate serving as a dispersant, and this is put into from 100 ml to 150 ml of an electrolytic solution. The electrolytic solution in which the sample has been suspended is dispersed in an ultrasonic disperser for 1 minute, and then, using Coulter Multisizer II Model (by Beckman Coulter) with an aperture having an aperture diameter of 50 μm, the particle size distribution of the particles of which the particle size falls within a range of from 1.0 μm to 30 μm is determined. The number of the particles to be analyzed is 50,000.

The thus-determined particle size distribution is accumulated to draw a cumulative volume distribution from the smallest particle diameter for divided particle size ranges (channels), and the particle diameter corresponding to 50% in the cumulative volume distribution is defined as the volume-average particle diameter (D50v).

The particle size distribution of the toner is expressed by the square root of the ratio of the 16% diameter (D16p) to the 84% diameter (D84p), as calculated from the smallest particle number size of the toner, and this is referred to as GSDp.

In case where the particle diameter of the particles to be analyzed is less than 2 μM, the particles are analyzed with a laser diffraction-type particle sizer (LA-700, by Horiba Seisakusho). The measurement method is as follows: The sample to be analyzed in the form of a dispersion liquid thereof is controlled to be in a weight of 2 g as the solid content thereof, and ion-exchanged water is added thereto to be 40 ml. This is put into a cell to have a suitable concentration therein, and after 2 minutes and when the concentration inside the cell has become stable, analyzing the same is started. The thus-determined particle size distribution is accumulated to draw a cumulative volume distribution from the smallest volume-average particle diameter for every channel, and the particle diameter corresponding to 50% in the cumulative volume distribution is defined as the volume-average particle diameter.

In case where a powder of external additive or the like is analyzed, 2 g of the powder is put into 50 ml of an aqueous 5% solution of sodium alkylbenzenesulfonate, dispersed with an ultrasonic disperser (1000 Hz) for 2 minutes to prepare a sample for the measurement, and this is analyzed according to the same method for dispersion liquid as mentioned above.

The shape factor SF1 of the toner particles is, for example, within a range of from 110 to 140.

The shape factor SF1 may be determined according to the following formula:

$$SF1=(ML^2/A)\times(\pi/4)\times 100$$

In the above formula, ML means the absolute maximum length of the toner particle, and A means the projected area of the toner particle.

SF1 may be digitized, for example, by analyzing the microscopic image or the scanning electromicroscopic (SEM) image with an image analyzer. Concretely, for example, the microscopic image of the toner scattered on the surface of a slide glass is inputted into a Luzex image analyzer through a video camera, and the maximum length and the projected area of at least 50 toner particles are measured and calculated according to the above formula to determine the mean value.

—External Additive—

The external additive is described below.

As the external additive, inorganic particles are exemplified. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, etc.

The surface of the external additive may be subjected to a hydrophobization treatment in advance. The hydrophobization treatment is carried out by, for example, immersing the inorganic particles in a hydrophobization treating agent, or the like. The hydrophobization treating agent is not particularly limited, but examples of the hydrophobization treating agent include a silane-based coupling agent, silicone oil, a titanate-based coupling agent, an aluminum-based coupling agent, and the like. These may be used singly, or in a combination of two or more kinds thereof.

The amount of the hydrophobization treating agent may be generally, for example, from 1 part by mass to 10 parts by mass or so relative to 100 parts by mass of the external additive.

The amount of the external additive to be externally added to the system may be, for example, from 0.5 parts by mass to 2.5 parts by mass relative to 100 parts by mass of the toner particles.

—Toner Production Method—

A production method for the toner of the exemplary embodiment of the invention is described below.

First described is a production method for toner particles.

The toner particles are formed by aggregating and fusing particles of a polyester resin, particles of a styrene resin and particles of a coloring agent in a starting material dispersion liquid of those particles dispersed in an aqueous solvent, or by aggregating and fusing resin particles containing both a polyester resin and a styrene resin and particles of a coloring agent in a starting material dispersion liquid of those particles dispersed in an aqueous solvent.

One example of the production method for toner particles is described in detail hereinunder.

In the following description, the wording "resin particles" means any one of particles of a polyester resin and particles of a styrene resin, or resin particles containing both a polyester resin and a styrene resin.

A method of producing toner particles containing a release agent is described below, in which, however, the release agent is optionally used. Needless-to-say, any other additive than the coloring agent and the release agent may be used here.

(Step for Preparing Resin Particles Dispersion Liquid)

First, along with a resin particles dispersion liquid of resin particles dispersed therein, for example, a coloring agent particles dispersion liquid of coloring agent particles dispersed therein and a release agent particles dispersion liquid of release agent particles dispersed therein are prepared.

The resin particles dispersion liquid may be prepared, for example, by dispersing resin particles in a dispersant by the action of a surfactant therein.

As the dispersant for use for the resin particles dispersion liquid, for example, an aqueous solvent may be used.

The aqueous solvent includes, for example, water such as distilled water, ion-exchanged water, etc.; alcohols, etc. One or more of these may be used here either singly or as combined.

Not specifically defined, the surfactant includes, for example, anionic surfactants such as sulfate ester salts, sulfonate salts, phosphate esters, soap, etc.; cationic surfactants such as amine salts, quaternary ammonium salts, etc.; nonionic surfactants such as polyethylene glycols, alkylphenol ethyleneoxide adducts, polyalcohols, etc. Of those, preferred are anionic surfactants and cationic surfactants. Nonionic surfactants may be combined with anionic surfactant or cationic surfactant.

One alone or two or more different types of surfactants may be used here either singly or as combined.

As a method of dispersing resin particles in a dispersant to prepare a resin particles dispersion liquid, for example, there may be mentioned an ordinary dispersion method of using a rotary shearing homogenizer, a media-assisted ball mill, a sand mill, a Dyno mill or the like. Depending on the type of the resin particles to be used, for example, the resin particles may be dispersed to prepare the resin particles dispersion liquid according to a phase inversion emulsification method.

The phase inversion emulsification method is a method in which the resin to be dispersed is dissolved in a hydrophobic organic solvent capable of dissolving the solvent, then a base is added to the organic continuous phase (O phase) to neutralize it, and thereafter an aqueous solvent (W phase) is put into it to attain resin conversion (so-called phase inversion) of from W/O to O/W to provide a discontinuous phase thereby dispersing the resin in the aqueous solvent as particles therein.

The volume-average particle diameter of the resin particles to be dispersed to give the resin particles dispersion liquid is, for example, within a range of from 0.01 μm to 1 μm, but may be from 0.08 μm to 0.8 μm, or may be from 0.1 μm to 0.6 μm.

The volume-average particle diameter of the resin particles may be determined, using a laser diffraction-type particle sizer (Horiba Seisakusho's LA-920).

The content of the resin particles contained in the resin particles dispersion liquid may be, for example, from 5% by mass to 50% by mass, but may be from 10% by mass to 40% by mass.

Like the resin particles dispersion liquid, for example, a coloring agent dispersion liquid and optionally a release agent dispersion liquid may be prepared. Briefly, regarding the volume-average particle diameter of the particles, the dispersion solvent, the dispersion method and the content of the particles for the resin particles dispersion liquid, the same shall apply also to the coloring agent particles to be dispersed in the coloring agent dispersion liquid and to the release agent particles to be dispersed in the release agent dispersion liquid.

(Step for Forming Aggregated Particles)

Next, the resin particles dispersion liquid is mixed with the coloring agent particles dispersion liquid and optionally with the release agent dispersion liquid.

In the mixed dispersion liquid, the binder resin particles are hetero-aggregated with the coloring agent particles and the release agent particles to give aggregated particles containing the resin particles, the coloring agent particles and the release agent particles and having a diameter close to the diameter of the intended toner particles.

Concretely, for example, an aggregating agent is added to the mixed dispersion liquid and the pH of the mixed dispersion liquid is controlled to be acidic (for example, pH of from 2 to 5), and if desired, a dispersion stabilizer is added thereto and the mixture is then heated at a temperature of the glass transition temperature of the resin particles (concretely, for example, at a temperature of from glass transition temperature—30° C. to glass transition temperature—10° C.) to thereby aggregate the particles dispersed in the mixed dispersion liquid to form aggregated particles.

In the step for forming aggregated particles, for example, the above-mentioned aggregating agent may be added to the mixed dispersion liquid kept stirred with a rotary shearing homogenizer, at room temperature (for example, 25° C.), the pH of the mixed dispersion liquid is controlled to be acidic (for example, pH of from 2 to 5), and if desired, a dispersion stabilizer is added thereto and the mixture may be heated as above.

As the aggregating agent, for example, usable here is a surfactant having an opposite polarity to that of the surfactant used here as the dispersant to be added to the mixed dispersion liquid, for example, including an inorganic metal salt, and a divalent or more polyvalent metal complex. In particular, when a metal complex is used as the aggregating agent, the amount of the surfactant to be used may be reduced and the charging characteristics of the dispersion liquid could be thereby bettered.

If desired, an additive capable of forming a complex or a compound having a similar bonding mode with the metal ion of the aggregating agent may be optionally used. As the additive of the type, preferred is a chelate agent.

The inorganic metal salt includes, for example, metal salts such as calcium chloride, calcium nitrate, barium chloride, magnesium chloride, zinc chloride, aluminium chloride, aluminium sulfate, etc.; and inorganic metal salt polymers such as polyaluminium chloride, polyaluminium hydroxide, polycalcium sulfide, etc.

As the chelate agent, a water-soluble chelate agent may be used here. The chelate agent includes, for example, oxycarboxylic acids such as tartaric acid, citric acid, gluconic acid, etc.; and imino diacid (IDA), nitrilotriacetic acid (NTA), ethylenediamine-tetraacetic acid (EDTA), etc.

The amount of the chelate agent to be added may be, for example, within a range of from 0.01 parts by mass to 5.0 parts by mass relative to 100 parts by mass of the binder resin, polyester resin particles, and may also be 0.1 parts by mass or more and less than 3.0% by mass.

(Fusing/Coalescing Step)

Next, the aggregated particles dispersion liquid of the aggregated particles dispersed therein is heated, for example, at a temperature not lower than the glass transition temperature of the binder resin, polyester resin particles (for example, at a temperature higher by from 10 to 30° C. than the glass transition temperature of the resin particles) to thereby fuse/coalesce the aggregated particles to form toner particles. As a result of the above-mentioned process, the toner particles are formed.

The step of forming the aggregated particles dispersion liquid of the aggregated particles dispersed therein may be followed by a step of further mixing the aggregated particles dispersion liquid with the resin particles dispersion liquid of the resin particles dispersed therein to thereby make the resin particles further adhere to and aggregate on the surfaces of the aggregated particles to form secondary aggregated particles after obtaining the aggregated particles dispersion liquid of the aggregated particles dispersed therein, and a step of heating the secondary aggregated particles dispersion liquid of the secondary aggregated particles dispersed therein to thereby fuse/coalesce the secondary aggregated particles to form core/shell structured toner particles.

After the fusing/coalescing step, the toner particles formed in the liquid are separated according to a washing step, a solid-liquid separation step and a drying step known in the art, thereby giving dry toner particles.

Preferably in the washing step, the particles are fully washed in a mode of substitution washing with ion-exchanged water from the viewpoint of the charging characteristics of the particles. The solid-liquid separation step is not specifically defined, in which, however, the liquid is processed preferably in a mode of suction filtration, pressure filtration or the like from the viewpoint of the producibility of the particles. The drying step is not also specifically defined, in which, however, preferably employed is a mode of freeze drying, flash jet drying, fluidized drying, vibrating fluidized drying or the like from the viewpoint of the producibility of the particles.

If desired, an external additive and any other additive may be mixed with the toner particles thus formed in the manner as above, thereby producing a toner. For mixing them, for example, usable is any known mixing machine such as a V-shaped blender, a Henschel mixer, a Ledige mixer, etc.

The other additive includes, for example, a fluidizing agent, a cleaning aid or a transfer aid of polystyrene particles, polymethyl methacrylate particles, polyvinylidene fluoride particles or the like.

(Carrier)

The carrier has a core particle and a resin coating layer to coat the surface of the core particle. The ratio of the exposed area of the core particle to the surface of the carrier is 7% or less or about 7% or less.

—Core Particle—

Not specifically defined, the core particle may be any known particle usable as a core particle for carrier. Concretely, for example, a magnetic particle may be used as the core particle, or a magnetic particles-dispersed resin particle in which magnetic particles are dispersed in a resin may be used as the core particle.

The magnetic material for the magnetic particle includes, for example, magnetic metals such as iron, copper, nickel, cobalt, etc.; alloys of such a magnetic metal with manganese, chromium, rare earth element or the like; magnetic oxides such as ferrite magnetite, etc.

In case where a magnetic particle is used as the core particle, the magnetic particles may be formed through granulation and sintering; and as pretreatment for them, the magnetic material may be ground. Not specifically defined, the grinding method may be any known grinding method. Concretely, for example, usable is a mortar, a ball mill, a jet mill or the like for the grinding method.

The sintering temperature may be lower than usual. Concretely, the temperature may vary depending on the material to be used, and is, for example, from 500° C. to 1200° C., but preferably from 600° C. to 1000° C. For lowering the sintering temperature, for example, the particles may be stepwise partially sintered in the sintering step. In the case, the time for the entire sintering may be prolonged.

In case where a magnetic particle-dispersed resin particle is used as the core particle, the content of the magnetic particle in the core particle is, for example, from 80% by mass to 99% by mass, and may be from 95% by mass to 99% by mass.

The volume-average particle diameter of the magnetic particle contained in the magnetic particle-dispersed resin particle is, for example, from 0.05 μm to 5.0 μm, and may be from 0.1 μm to 1.0 μm. The volume-average particle diameter of the magnetic particle may be determined with a laser diffraction/scattering particle sizer.

Regarding the method for forming the magnetic particle to be contained in the magnetic particle-dispersed resin particle, for example, there may be mentioned a method of applying mechanical shearing force to the powdery particle of the magnetic material mentioned above, and if desired, a coupling agent that serves as a surface modifier may be added thereto.

Not specifically defined, the resin for the magnetic particle-dispersed resin particle includes, for example, styrene resin, acrylic resin, phenolic resin, melamine resin, epoxy resin, urethane resin, polyester resin, silicone resin, etc.

If desired, the magnetic particle-dispersed resin particle may further contain a charge controlling agent and any other component such as fluorine-containing particle or the like, in accordance with the object thereof.

The volume-average particle diameter of the core particle is, for example, from 10 μm to 500 μm, and may be from 20 μm to 100 μm and may also be from 25 μm to 60 μm.

Regarding the magnetic force of the core particle, for example, the saturation magnetization thereof at 3000 Oe may be at least 50 emu/g, and may also be at least 60 emu/g.

For measuring the magnetic force of the core particle, used is a vibrating sample magnetometer VSMP10-15 (by Tohei Industry). The sample to be analyzed is charged in a cell having an inner diameter of 7 mm and a height of 5 mm, and set in the apparatus. For the measurement, a magnetic field is given to the sample, and swept down to at most 3000 Oe. Next, the applied magnetic field is reduced, and a hysteresis curve is drawn on a recording paper. From the data of the curve, the saturation magnetization, the residual magnetization and the coercive force are derived. The saturation magnetization of the core particle indicates the magnetization measured in a magnetic field at 3000 Oe.

The volume electric resistance (volume resistivity) of the core particle is, for example, preferably within a range of from $10^5$ Ω·cm to $10^{9.5}$ Ω·cm or from about $10^5$ Ω·cm to about $10^{9.5}$ Ω·cm, and may be within a range of from $10^7$ Ω·cm to $10^9$ Ω·cm or from about $10^7$ Ω·cm to about $10^9$ Ω·cm.

The volume electric resistance (Ω·cm) of the core particle may be measured as follows: The measurement environment is at a temperature of 20° C. and a humidity of 50% RH. The sample to be analyzed is flatwise put on the surface of a circular jig equipped with an electrode plate of 20 $cm^2$, in a thickness of from 1 mm to 3 mm to thereby form a layer thereon. The electrode plate of 20 $cm^2$ is then put on it to sandwich the layer therebetween. For eliminating the void around the sample, a load of 4 kg is applied to the electrode plate set on the layer, and the thickness (cm) of the layer is measured. The two electrodes above and below the layer each are connected to an electrometer and a high-voltage power supply unit. A high voltage is applied so that the electric field between the two electrodes could be 103.8 V/cm, and the current value (A) in this state is read, thereby calculating the volume electric resistance (Ω·cm) of the sample. The calculation formula for the volume electric resistance (Ω·cm) of the sample is as shown below.

$$R=E\times 20/(I-I_0)/L$$

In the above formula, R is the volume electric resistance (Ω·) of the sample analyzed; E is the applied voltage (V); I is the current value (A); $I_0$ is the current value (A) at an applied voltage 0 V, L is the thickness (cm) of the layer. The coefficient 20 indicates the area ($cm^2$) of the electrode plate.

—Resin Coating Layer—

The ratio of the exposed area of the core particle to the surface of the carrier is preferably as small as possible. Concretely, the ratio of the exposed area of the core particle to the surface of the carrier is 7% or less or about 7% or less, preferably 5% or less or about 5% or less, more preferably 1% or less or about 1% or less.

The ratio of the exposed area of the core particle to the surface of the carrier may be determined through XPS (X-ray photoelectron spectrometry) to measure the coating ratio of the coating layer to the core particle, according to the method mentioned below. For XPS, used is an XPS device, JEOL's JPS80 in which MOW ray is used as the X ray source, the accelerating voltage is 10 kV and the emission current is 20 mV; and the main element (generally carbon) to constitute the coating layer and the main element (generally iron) to constitute the core particle are analyzed.

A case where the core particle is formed of an iron oxide material is described below. In this, the C1s spectrum is measured for carbon, the Fe2p3/2 spectrum is for iron, and the O1s spectrum for oxygen. Based on the spectrum of each element, the number of the elements, carbon, oxygen and iron (represented by "AC", "AO" and "AFe", respectively) is determined; and from the ratio of the number of the elements, carbon, oxygen and iron, the iron amount ratio of the core particle simple body and that of the coating layer-coated core particle (carrier) are calculated, and subsequently, the coating ratio is calculated according to the following formulae.

$$\text{Iron Amount Ratio (atomic \%)}=AFe/(AC+AO+AFe)\times 100$$

$$\text{Coating Ratio (\%)}=\{1-(\text{iron amount ratio of carrier})/(\text{iron amount ratio of core particle simple body})\}\times 100$$

In case where any other material than an iron oxide-based material is used for the core particle, the spectrum of the metal element constituting the core particle except oxygen is measured, and the coating ratio is calculated according to the above-mentioned formulae in the same manner as above.

The mean thickness of the coating layer may be, for example, from 0.1 μM to 10 μm or from about 0.1 μm to about 10 μm, but is preferably from 0.1 μm to 3.0 μm or from about 0.1 μm to about 3.0 μm.

The mean thickness (μm) of the coating layer may be calculated according to the following formula, in which ρ (non-dimensional) means the true specific gravity of the core particle; d (μ) means the volume-average particle diameter of the core particle; $\rho_c$ means the mean specific gravity of the coating layer; and $W_c$ (part by mass) means the total content of the coating layer relative to 100 parts by mass of the core particle:

$$\begin{aligned}\text{Mean Thickness } (\mu\text{m}) = {} & [\text{coating resin amount per one carrier} \\ & \text{(including all additives such as} \\ & \text{electroconductive powder and others)/} \\ & \text{surface area per one carrier]/} \\ & \text{mean specific gravity of coating layer} \\ = {} & [4/3\pi\cdot(d/2)^3\cdot\rho\cdot W_c]/[4\pi\cdot(d/2)^2]/\rho_c \\ = {} & (1/6)\cdot(d\cdot\rho\cdot W_c/\rho_c).\end{aligned}$$

Preferably, the coating layer coats the core particle in a range of from 0.5 parts by mass to 10 parts by mass relative to 100 parts by mass of the core particle, more preferably in a range of from 1 part by mass to 5 parts by mass.

The resin contained in the coating layer includes, for example, acrylic resin, polyethylene resin, polypropylene resin, polystyrene resin, polyacrylonitrile resin, polyvinyl acetate resin, polyvinyl alcohol resin, polyvinyl butyral resin, polyvinyl chloride resin, polyvinyl carbazole resin, polyvinyl ether resin, polyvinyl ketone resin, vinyl chloride/vinyl acetate copolymer, styrene/acrylic acid copolymer, organosiloxane bond-having straight silicone resin or its modified derivatives, fluororesin, polyester resin, polyurethane resin, polycarbonate resin, phenolic resin, amino resin, melamine resin, benzoguanamine resin, urea resin, amide resin, epoxy resin, etc.

Of those, preferred is a resin containing a cycloalkyl (meth) acrylate as the polymerization component thereof (this may be hereinafter referred to as a cycloalkyl group-having (meth) acrylic resin), as the resin to constitute the coating layer.

The cycloalkyl group-having (meth)acrylic resin includes a homopolymer of a cycloalkyl (meth)acrylate, and a copolymer of a cycloalkyl (meth)acrylate with any other monomer.

The cycloalkyl (meth)acrylate includes, for example, cyclopentyl acrylate, cyclopentyl methacrylate, cyclohexyl acrylate, cyclohexyl methacrylate, cyclooctyl acrylate, cyclooctyl methacrylate, etc.

Of those, cyclohexyl methacrylate is preferred as the cycloalkyl (meth)acrylate.

Preferably, the cyclohexyl group-having acrylic resin contains the polymerization component derived from a cycloalkyl (meth)acrylate in an amount of, for example, at least 80% by mass.

The weight-average molecular weight of the resin contained in the coating layer may be, for example, from 5,000 to 1,000,000 or from about 5,000 to about 1,000,000, but is preferably from 10,000 to 200,000 or from about 10,000 to about 200,000.

The coating layer may contain an electroconductive particle. The electroconductive particles include, for example, carbon black; metals such as gold, silver, copper; and titanium oxide, zinc oxide, barium sulfate, aluminium borate, potassium titanate, tin oxide.

The content of the electroconductive particle may be from 1% by mass to 50% by mass, but is preferably from 3% by mass to 20% by mass.

—Physical Properties of Carrier—

The number-average particle diameter of the carrier may be, for example, from 15 μm to 50 μm, and may also be from 20 μm to 40 μm.

The number-average particle diameter may be determined by measuring the maximum diameter of the individual particles on the electroscopic SEM picture of the carrier followed by calculating the mean value of the found data of 100 particles. The volume electric resistance (at 25° C.) of the carrier is, for example, within a range of from $1\times10^7$ Ω·cm to $1\times10^{15}$ Ω·cm or from about $1\times10^7$ Ω·cm to about $1\times10^{15}$ Ω·cm, and may be within a range of from $1\times10^8$ Ω·cm to $1\times10^{14}$ Ω·cm or from about $1\times10^8$ Ω·cm to about $1\times10^{14}$ Ω·cm, or within a range of from $1\times10^8$ acm to $1\times10^{13}$ Ω·cm or from about $1\times10^8$ Ω·cm to about $1\times10^{13}$ Ω·cm.

The volume electric resistance of the carrier may be measured in the same manner as that for the volume electric resistance of the core particle mentioned above.

—Method for Production of Carrier—

As the method for producing the carrier, preferred is a method of adhering the above-mentioned magnetic particles and the resin particles contained in the resin coating layer, or the above-mentioned magnetic particles-dispersed resin particles and the resin particles contained in the resin coating layer, to the core particles through mechanical shock given thereto. The method of giving mechanical shock to the particles may be carried out, for example, by putting the core particles and the resin particles contained in the resin coating layer into a dry processing device such as Nobilta (by Hosokawa Micron), Vertical Granulator (by Powrex), Henschel mixer (by Shimadzu) or the like, and mixing them therein.

A case of giving mechanical shock by the use of Nobilta is described below.

The floor-space ratio of Nobilta to be used is preferably from 10% by mass to 80% by mass, more preferably from 20% by mass to 70% by mass.

The revolution number is preferably from 500 rpm to 5000 rpm, more preferably from 800 rpm to 4000 rpm.

The process temperature is preferably from 10° C. to 100° C., more preferably from 20° C. to 80° C.

In order that the ratio of the exposed area of the core particle to the surface of the carrier could be 7% or less or about 7% or less, preferably, the revolution number is increased or the temperature control is attained accurately; and in addition thereto, the temperature control in the stage of premixing the particles prior to giving mechanical shock thereto is concretely such that the particles are kept at a temperature higher by from 10° C. to 20° C. than the glass transition temperature of the resin to form the resin coating layer for from 30 minutes to 60 minutes or so.

(Method for Production of Electrostatic Latent Image Developer)

The electrostatic latent image developer of the exemplary embodiment of the invention (hereinafter this may be referred to as "developer") contains the above-mentioned toner and the above-mentioned carrier.

The blend ratio (by mass) of the toner and the carrier may be, for example, within a range of from 1/100 to 30/100 as toner/carrier, but is preferably within a range of from 3/100 to 20/100.

[Charging Device]

The charging device 20 is, for example, a contact charger using an electroconductive charging roller, charging brush, charging film, charging rubber blade, charging tube or the like. The charging device 20 further includes, for example, per-se known chargers such as noncontact roller charger, as well as corona discharge-assisted corotron charger or scorotron charger, etc. As the charging device 20, preferred is a contact charger.

[Exposure Device]

The exposure device 30 is, for example, an optical instrument for imagewise exposing the surface of the electrophotographic photoreceptor 10 (one example of image holding member) to a semiconductor laser light, an LED light, a liquid-crystal shutter light or the like. The wavelength of the light source is preferably within the spectral sensitivity region of the electrophotographic photoreceptor 10. As the wavelength of the semiconductor laser light, for example, preferred is a near infrared light having an emission wavelength at around 780 nm. However, the wavelength is not limited to the range. Also usable here is a laser light having an emission wavelength at around 600 nm as well as a laser light having an emission wavelength at from 400 nm to 450 nm as a blue laser light. As the exposure device 30, for example, also effectively usable here is a surface-emitting laser light source of a type of multibeam emission for color image formation.

[Developing Device]

The developing device 40 is, for example, arranged to face the electrophotographic photoreceptor 10 in the development region, and has, for example, a developer tank 41 to hold therein a two-component developer containing a toner and a carrier. The developer tank 41 has a developer tank body 41A and a developer tank cover 41B that covers the top of the tank body.

The developer tank body 41A has, for example, on its inner side, a developing roller chamber 42A that holds a developing roller 42 (one example of developer holding member) and has a first stirring chamber 43A adjacent to the developing roller chamber 42A, and a second stirring chamber 44A adjacent to the first stirring chamber 43A. Further, in the developing roller chamber 42A, for example, a control member 45 is provided to control the layer thickness of the developer on the surface of the developing roller 42 when the developer tank body 41A is covered with the developer tank cover 41B.

The control member 45 is arranged to face the developing roller 42, as spaced therefrom, on the upstream side in the rotation direction of the developing roller 42 from the development region.

The control member 45 has a tabular shape in the part thereof that faces the developing roller 42, and that part of the member is arranged along the axial direction of the developing roller 42.

The distance between the control member 45 and the developing roller 42 is preferably from 0.2 mm to 0.8 mm or from about 0.2 mm to about 0.8 mm, more preferably from 0.4 mm to 0.7 mm or from about 0.4 mm to about 0.7 mm.

The above-mentioned distance means the shortest distance between the part of the control member 45 to face the developing roller 42 and the outer peripheral surface of the developing roller 42 to face the control member 45.

The first stirring chamber 43A and the second stirring chamber 44A are divided by, for example, a partition wall 41C. Though not shown, openings are provided at the two edge portions in the longitudinal direction of the partition wall 41C so that the first stirring chamber 43A and the second stirring chamber 44A are connected. The first stirring chamber 43A and the second stirring chamber 44A constitute a circulating stirring chamber (43A+44A).

In the developing roller chamber 42A, the developing roller 42 is arranged so as to face the electrophotographic photoreceptor 10. In the developing roller 42, though not shown, a sleeve is provided at the outside of a magnetic roller (fixed magnet) having magnetism. The developer in the first stirring chamber 43A is adsorbed on the surface of the developing roller 42 by the magnetic force of the magnetic roller, and conveyed to the development region. The developing roller 42 is supported by the developer tank body 41A such that the roller axis of the developing roller is freely rotatable. Here, the developing roller 42 rotates in the rotation direction opposite to the rotation direction of the electrophotographic photoreceptor 10, and at the opposing portion, the developer that has been adsorbed on the surface of the developing roller 42 is conveyed to the development region in the same direction as the moving direction of the electrophotographic photoreceptor 10. In this, the developer is conveyed to the development region while its dose is controlled by the control member 45.

Further, a bias power source (not shown) is connected to the sleeve of the developing roller 42 so that a developing bias is to be applied.

In the first stirring chamber 43A and the second stirring chamber 44A, a first stirring member 43 (stirring and conveying member) and a second stirring member 44 (stirring and conveying member) which stir and convey the developer are arranged. The first stirring member 43 includes a first rotation axis that extends in the axial direction of the developing roller 42, and stirring and conveying blades (protruding portions) that are fixed in a spiral state on the outer circumference of the rotation axis. Similarly, the second stirring member 44 includes a second rotation axis and stirring and conveying blades (protruding portions). The stirring members are supported by the developer tank body 41A so as to rotate freely. The first stirring member 43 and the second stirring member 44 are disposed such that, by their rotation, the developer in the first stirring chamber 43A and the developer in the second stirring chamber 44A are each conveyed in the opposite directions to each other.

[Transferring Device]

Examples of the primary transferring device 51 and the secondary transferring device 52 include a transferring charger, which is already known, such as a contact transferring charger using a belt, a roller, a film, a rubber blade or the like, as well as a scorotron transferring charger or a corotron transferring charger using corona discharge.

As the intermediate transfer body 50, a belt-shaped intermediated transfer body (intermediate transfer belt) formed from polyimide, polyamideimide, polycarbonate, polyarylate, polyester, rubber, or the like, each of which contains an electroconductive agent, is used. Further, regarding the form of the intermediate transfer body, a cylindrical intermediated transfer body, other than a belt-shaped intermediated transfer body, may be used.

[Cleaning Device]

The cleaning device 70 includes a casing 71, a cleaning blade 72 which is disposed so as to protrude from the casing 71, and a lubricant supply device 60 arranged on the upstream side of the cleaning blade 72 in the rotation direction of the electrophotographic photoreceptor 10.

In addition, the cleaning blade 72 may have a configuration supported by the edge portion of the casing 71, or a configuration supported by an additional holder member. In exemplary embodiment of the invention, the cleaning blade 72 is illustrated as a configuration supported by the edge portion of the casing 71.

First, the cleaning blade 72 is described.

Examples of the material that forms the cleaning blade 72 include urethane rubber, silicone rubber, fluorine-containing rubber, propylene rubber, butadiene rubber, etc. Among them, urethane rubber is preferred.

The urethane rubber (polyurethane) is not particularly limited as long as it is conventionally used for forming polyurethane. For example, there is mentioned a urethane prepolymer formed from a polyol (for example, a polyester polyol such as polyethylene adipate, polycaprolactone, etc.) and an isocyanate (for example, diphenylmethane diisocyanate, etc.). In addition, for the urethane rubber (polyurethane), a crosslinking agent such as 1,4-butanediol, trimethylolpropane, ethylene glycol or their mixture may be used as the starting material.

Next, the lubricant supply device 60 is described.

The lubricant supply device 60 is provided, for example, inside the cleaning device 70 and on the upstream side in the rotation direction of the electrophotographic photoreceptor 10 separated from the cleaning blade 72.

The lubricant supply device 60 includes, for example, a revolving brush 61 that is arranged so as to be in contact with the electrophotographic photoreceptor 10, and a solid state lubricant 62 that is arranged so as to be in contact with the revolving brush 61. In the lubricant supply device 60, when the revolving brush 61 revolves in the state of being in contact with the solid state lubricant 62, the lubricant 62 adheres to the revolving brush 61, and the adhered lubricant 62 is supplied to the surface of the electrophotographic photoreceptor 10, whereby a film of the lubricant 62 is formed.

It should be noted that the configuration of the lubricant supply device 60 is not limited to the above. For example, the lubricant supply device 60 may have a configuration in which a rubber roller is used in place of the revolving brush 61.

[Operation of Image Forming Apparatus 101]

Next, the operation of the image forming apparatus 101 of the exemplary embodiment of the invention is described. First, the surface of the electrophotographic photoreceptor 10 is charged negatively by the charging device 20, while the electrophotographic photoreceptor 10 is rotated in the direction indicated by the arrow a.

The electrophotographic photoreceptor 10 whose surface has been charged negatively by the charging device 20 is exposed by the exposure device 30, to form a latent image on the surface of the electrophotographic photoreceptor.

The portion of the electrophotographic photoreceptor 10 in which the latent image has been formed is conveyed toward the developing device 40. By the action of the developing device 40 (developing roller 42), the toner adheres to the latent image to form a toner image.

The electrophotographic photoreceptor 10 having the toner image formed thereon is further rotated in the direction indicated by the arrow a, and the toner image is transferred to the outer surface of the intermediate transfer body 50.

When the toner image is transferred to the intermediate transfer body 50, the recording paper P is supplied to the secondary transfer device 52 by the recording paper supply device 53, and the toner image that has been transferred to the intermediate transfer body 50 is transferred onto the recording paper P by the secondary transfer device 52. In this way, the toner image is formed on the recording paper P.

The toner image formed on the recording paper P is fixed thereon by the fixing device 80.

After the toner image has been transferred to the intermediated transfer body 50, the lubricant 62 is supplied to the surface of the electrophotographic photoreceptor 10 by the lubricant supply device 60, and a film of the lubricant 62 is formed on the surface of the electrophotographic photoreceptor 10. Thereafter, the toners or discharge products remaining on the surface are removed by the cleaning blade 72 of the cleaning device 70. The electrophotographic photoreceptor 10, which is cleaned in the cleaning device 70 by removing the toners or discharge products remaining after the transfer, is charged again by the charging device 20 and then, is exposed by the exposure device 30 to form a latent image.

[Process Cartridge]

Figure 2:
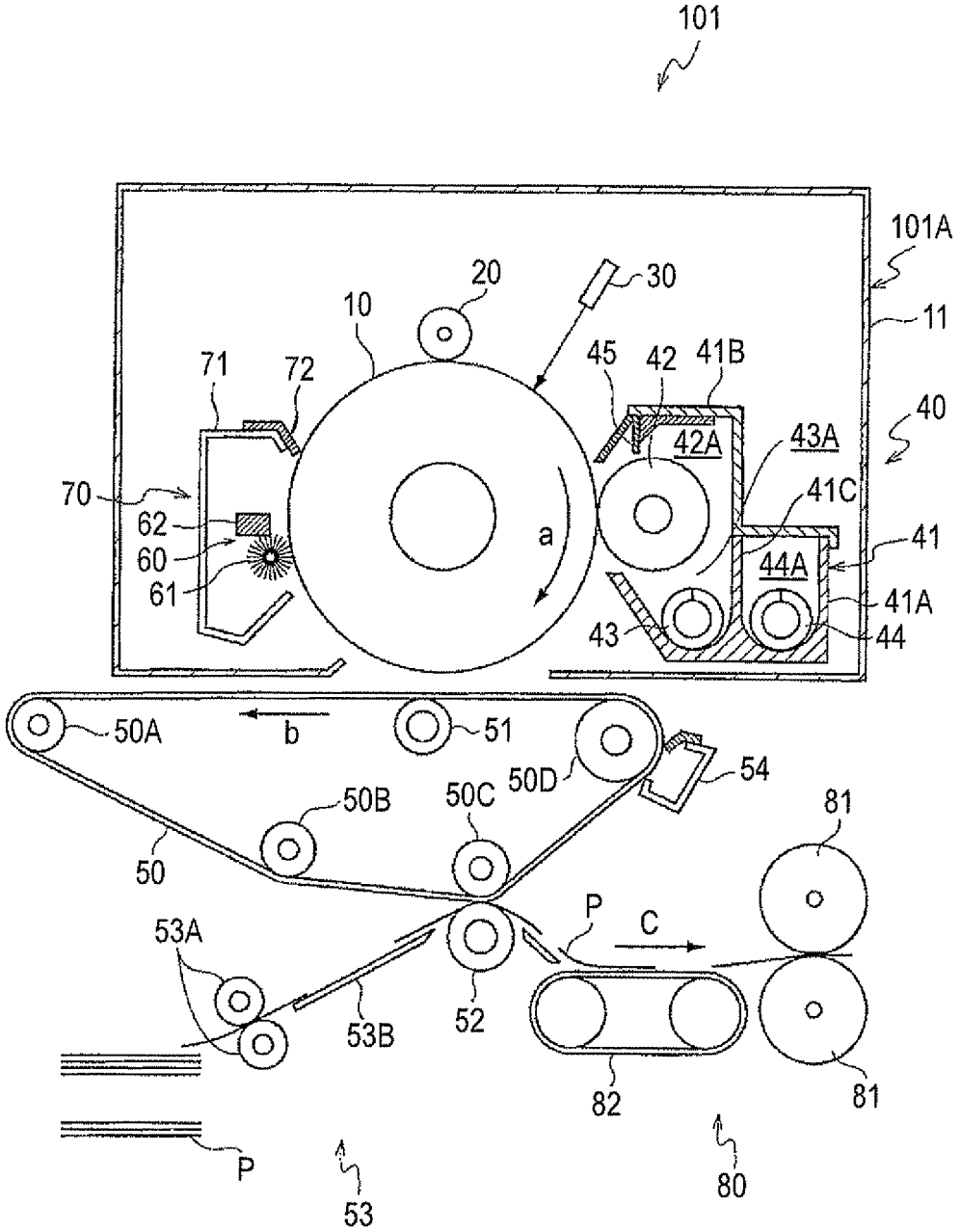

Apart from the above-mentioned exemplary embodiment of the invention, the image forming apparatus 101 according to another exemplary embodiment of the invention may have a configuration equipped with, for example, as shown in FIG. 2, a process cartridge 101A that integrates and holds therein an electrophotographic photoreceptor 10, a charging device 20, a developing device 40, a lubricant supply device 60, and a cleaning device 70 in a casing 11. This process cartridge 101A holds therein multiple members in an integrated form and is attachable to and detachable from the image forming apparatus 101.

The configuration of the process cartridge 101A is not limited to the above. Any configuration is applicable thereto as long as the process cartridge 101A is provided with at least the electrophotographic photoreceptor 10, and in addition thereto, for example, at least one selected from the charging device 20, the exposure device 30, the developing device 40, the primary transfer device 51, the lubricant supply device 60 and the cleaning device 70.

[Other Configuration]

The image forming apparatus 101 according to the exemplary embodiment of the invention is not limited to the above configuration. For example, the image forming apparatus 101 may include a first eraser, which aligns the polarities of the residual toners to easily remove the residual toners with the cleaning brush or the like, and which is provided around the electrophotographic photoreceptor 10 on the downstream side of the primary transferring device 51 in the rotation direction of the electrophotographic photoreceptor 10 but on the upstream side of the cleaning device 70 in the rotation direction of the electrophotographic photoreceptor. The image forming apparatus 101 may also include a second eraser, which erases the charges on the surface of the electrophotographic photoreceptor 10, and which is provided on the downstream side of the cleaning device 70 in the rotation direction of the electrophotographic photoreceptor but on the upstream side of the charging apparatus 20 in the rotation direction of the electrophotographic photoreceptor.

In addition, the image forming apparatus 101 according to the exemplary embodiment of the invention is not limited to the above configuration. Any known configuration may be used such as an image forming apparatus for directly transferring the toner image formed on the electrophotographic photoreceptor 10 onto the recording paper P, or a tandem type image forming apparatus.

[Mechanism of the Exemplary Embodiment of the Invention]

The latent image developer to be used in the image forming apparatus 101 of the exemplary embodiment of the invention described above incudes an electrostatic-latent-image-developing toner that has toner particles formed by aggregating and fusing particles of a polyester resin, particles of a styrene resin and particles of a coloring agent in a starting material dispersion liquid of those particles dispersed in an aqueous solvent, or by aggregating and fusing resin particles containing a polyester resin and a styrene resin and particles of a coloring agent in a starting material dispersion liquid of those particles dispersed in an aqueous solvent, and a carrier having a core particle and a resin coating layer to coat the surface of the core particle, in which the ratio of the exposed area of the core particle to the surface of the carrier is 7% or less or about 7% or less.

The toner particles, which the electrostatic-latent-image-developing toner to be contained in the developer of the exemplary embodiment of the invention has, contains a polyester resin and a styrene resin.

The resin formed of such different types of resins according to a so-called polymer blending method of blending the different resins shall have different properties that the individual resins have, and consequently, the resin of the type is considered to be useful as a resin to constitute toner particles.

On the other hand, the resin produced according to the polymer blending method shall have a different temperature-dependent volume change depending on the type of the resins blended, and therefore, in case where resins poorly compatible with each other are blended, the interface between the different resins would strain after cooled to thereby generate a stress between them.

Consequently, in the case where shock is given to the toner particles by stirring the developer, the toner particles that include the resin formed by the polymer blending method as the constituent component therein often tend to be broken.

Therefore, the developer of the exemplary embodiment of the invention is so designed as to include the electrostatic-latent-image-developing toner that has toner particles containing a polyester resin and a styrene resin and formed in an aqueous solvent, and the carrier having a core particle and a resin coating layer to coat the surface of the core particle in which the ratio of the exposed area of the core particle is small.

In the developer of the exemplary embodiment of the invention, the toner particles that the electrostatic-latent-image-developing toner has are formed by fusing and aggregating the starting material dispersion in an aqueous solvent.

In other words, the toner particles are those produced according to the so-called "chemical production method" in which the particles are formed in an aqueous solvent at a lower temperature than in conventional kneading and grinding methods, and therefore, the strain to occur in the formed particles is small and the stress generation can be thereby suppressed, and as a result, the toner particles could be prevented from being broken.

In addition, the carrier that the developer of the exemplary embodiment of the invention has is so designed that the core particle thereof is coated with a resin coating layer and that the ratio of the exposed area of the core particle to the surface of the carrier is small.

In other words, the developer of the exemplary embodiment of the invention contains the toner particles that are hardly broken and the carrier in which the ratio of the exposed area of the core particle is small; and therefore, for example, in case where the carrier and the toner collide with each other by stirring of the developer, the opportunity for the core particle, which has a higher hardness than that of the resin coating layer, to directly collide with the toner can be suppressed. Consequently, the toner particles are more hardly cracked and broken, and the toner breakage tends to be inhibited.

From the above, it is considered that the electrostatic latent image developer of the exemplary embodiment of the invention can be protected from destruction.

In the exemplary embodiment of the invention, a resin that contains a cycloalkyl (meth)acrylate as the polymerization component thereof is used for the carrier coating layer, and in particular, for the cycloalkyl (meth)acrylate, cyclohexyl methacrylate is preferred.

Accordingly, the toner is protected more effectively from destruction.

The reason would be as follows: A resin could grow like a coiled polymer while the polymerizing monomer for it is polymerized, however, a cycloalkyl group tends to grow while providing steric hindrance. Accordingly, the cycloalkyl group-having coiled polymer tends to be more bulky as compared with the other coiled polymer formed of the same number of polymerizing monomers, and can therefore absorb the shock to occur in collision with toner, whereby the toner can be protected from destruction.

It is considered that, when the content of the cycloalkyl group in the coating layer is increased, then the coating layer could be more effective for absorbing the shock to occur in collision with toner.

Preferably, the polyester resin contains bisphenol A as the polymerization component thereof.

Accordingly, the toner is protected more from destruction.

The reason is basically the same as above. Briefly, a resin could grow like a coiled polymer while the polymerizing monomer for it is polymerized. Bisphenol A has a structure in which two 4-hydroxyphenyl groups bond to the β-position of propane, and therefore readily provides steric hindrance between the phenyl groups therein. Accordingly, it is considered that the coiled configuration to constitute the resin is formed weakly and, as a result, the stress to occur inside the formed toner particles could be reduced.

It is considered that even when C.I. Pigment Yellow 74 is used as the coloring agent in the developer of the exemplary embodiment of the invention, the charging level change could be still kept low.

The reason is considered as follows: C.I. Pigment Yellow 74 has a high charging level among coloring agents. Therefore, when the toner is broken and when C.I. Pigment Yellow 74 is exposed out and adheres to the other non-broken toner or the carrier, then the charging level reduction of the entire developer is thereby cancelled and, as a result, the charging level change could be therefore suppressed.

In this connection, the conveying rate of a conventional developer is controlled by the control member 45 in the developing device 40, as described above, and therefore a force is given to the developer by the control member 45 and it may be considered that the toner would be thereby readily broken.

With that, in case where the distance between the control member 45 and the developing roller 42 is from 0.2 mm to 0.8 mm, the force by the control member 45 to be given to the developer tends to be especially great.

However, even in such a case, when the developer of the exemplary embodiment of the invention is used, the toner destruction can be prevented.

As a result, in the exemplary embodiment of the invention, it may be considered that the phenomenon of adhesion of fine powder of toner particle-constituting resin, coloring agent and the like, which is formed by destruction of toner particles, to the surface of the carrier could be prevented.

The above-mentioned fine powder is often difficult to develop, and therefore, when the fine powder adheres to the surface of the carrier, the condition would be kept as it is and, as a result, it is considered that the carrier would be kept in the condition where it could not exhibit the function thereof; however, in the exemplary embodiment of the invention, the toner is protected from destruction and therefore the phenomenon could be suppressed.

Accordingly, it is considered that, in the invention, the charging level depression in the electrostatic-latent-image-developing toner to be caused by the destruction of the toner could be prevented.

In addition, it is also considered that, since the toner is protected from destruction, the reduction in the proportion of the toner to be used for image formation in the electrostatic latent image developer, owing to the adhesion of the fine powder to the surface of the carrier, could be suppressed.

From the above, it is considered that, in the image forming apparatus 101 of the exemplary embodiment of the invention, the charging level depression in the electrostatic-latent-image-developing toner as well as the reduction in the proportion of the toner to be used for image formation therein, both caused by the destruction of the toner, could be well prevented, and as a result, a good image can be formed with reducing the lowing in the image density thereof.

EXAMPLES

Hereinafter, the invention will be further specifically described based on Examples given below. However, the invention is not limited to the following Examples. Unless otherwise specifically indicated, "part" is by mass.

<Toner>

(Production of Resin)

—Production of Resin 1—

| | |
|---|---|
| Polyoxyethylene (2,0)-2,2-bis(4-hydroxyphenyl)propane | 100 molar parts by mass |
| Terephthalic acid | 80 molar parts by mass |
| n-dodecenylsuccinic acid | 10 molar parts by mass |
| Isophthalic acid | 10 molar parts by mass |

The above components and, 0.05 parts by mass, relative to these acid components (total moles of terephthalic acid, n-dodecenylsuccinic acid and isophthalic acid), of dibutyltin oxide are put into a flask that has been dried by heating, then nitrogen gas is introduced into the container to keep an inert atmosphere therein and then heated, and thereafter the components are copolycondensed at from 150° C. to 240° C. for 12 hours.

Subsequently, the container is gradually depressurized at from 210° C. to 250° C. to produce a resin 1.

—Production of Resin 2—

A resin 2 is produced in the same manner as that for the resin 1, except that hexanediol is used in place of polyoxyethylene(2,0)-2,2-bis(4-hydroxyphenyl)propane.

—Production of Resin 3—

| | |
|---|---|
| Styrene | 296 parts by mass |
| n-butyl acrylate | 104 parts by mass |
| Acrylic acid | 6 parts by mass |
| n-dodecylmercaptan | 10 parts by mass |
| 2,2'-Azobisisobutyronitrile | 0.8 parts by mass |

The above components are put in a flask dried by heating, and mixed therein, and the mixture is purged with nitrogen, thereafter heated up to 70° C. and polymerized to produce a resin 3.

(Production of Resin Particles Dispersion Liquid)

—Production of Resin Particles Dispersion Liquid 1—

| | |
|---|---|
| Resin 1 | 4 parts by mass |
| Resin 3 | 46 parts by mass |

The above resins are dissolved in 167 parts by mass of ethyl acetate, then 2.5 parts by mass of an anionic surfactant (sodium dodecylbenzenesulfonate) is added thereto along with 250 parts by mass of ion-exchanged water, heated up to 60° C., and stirred with an emulsifier (Ultra Turrax T-50, by IKA) at 8000 rpm. Subsequently, ethyl acetate is evaporated away to give a resin particles dispersion liquid 1 having a volume-average particle diameter of 180 nm.

—Production of Resin Particles Dispersion Liquid 2—

A resin particles dispersion liquid 2 is produced according to the same method as that for the resin particles dispersion liquid 1 except that the resin 1 is 6 parts by mass and the resin 3 is 44 parts by mass. Its volume-average particle diameter is 180 nm.

—Production of Resin Particles Dispersion Liquid 3—

A resin particles dispersion liquid 3 is produced according to the same method as that for the resin particles dispersion liquid 1 except that the resin 1 is 7 parts by mass and the resin 3 is 43 parts by mass. Its volume-average particle diameter is 180 nm.

—Production of Resin Particles Dispersion Liquid 4—

A resin particles dispersion liquid 4 is produced according to the same method as that for the resin particles dispersion liquid 1 except that the resin 1 is 8 parts by mass and the resin 3 is 42 parts by mass. Its volume-average particle diameter is 180 nm.

—Production of Resin Particles Dispersion Liquid 5—

A resin particles dispersion liquid 5 is produced according to the same method as that for the resin particles dispersion liquid 1 except that the resin 1 is 9 parts by mass and the resin 3 is 41 parts by mass. Its volume-average particle diameter is 180 nm.

—Production of Resin Particles Dispersion Liquid 6—

A resin particles dispersion liquid 6 is produced according to the same method as that for the resin particles dispersion liquid 1 except that the resin 1 is 11 parts by mass and the resin 3 is 39 parts by mass. Its volume-average particle diameter is 180 nm.

—Production of Resin Particles Dispersion Liquid 7—

A resin particles dispersion liquid 7 is produced according to the same method as that for the resin particles dispersion liquid 1 except that the resin 1 is 14 parts by mass and the resin 3 is 36 parts by mass. Its volume-average particle diameter is 180 nm.

—Production of Resin Particles Dispersion Liquid 8—

A resin particles dispersion liquid 8 is produced according to the same method as that for the resin particles dispersion liquid 1 except that the resin 1 is 16 parts by mass and the resin 3 is 34 parts by mass. Its volume-average particle diameter is 180 nm.

—Production of Resin Particles Dispersion Liquid 9—

A resin particles dispersion liquid 9 is produced according to the same method as that for the resin particles dispersion liquid 1 except that the resin 1 is 19 parts by mass and the resin 3 is 31 parts by mass. Its volume-average particle diameter is 180 nm.

—Production of Resin Particles Dispersion Liquid 10—

A resin particles dispersion liquid 10 is produced according to the same method as that for the resin particles dispersion liquid 1 except that the resin 1 is 21 parts by mass and the resin 3 is 29 parts by mass. Its volume-average particle diameter is 180 nm.

—Production of Resin Particles Dispersion Liquid 11—

A resin particles dispersion liquid 11 is produced according to the same method as that for the resin particles dispersion liquid 1 except that the resin 1 is 24 parts by mass and the resin 3 is 26 parts by mass. Its volume-average particle diameter is 180 nm.

—Production of Resin Particles Dispersion Liquid 12—

A resin particles dispersion liquid 12 is produced according to the same method as that for the resin particles dispersion liquid 1 except that the resin 1 is 26 parts by mass and the resin 3 is 24 parts by mass. Its volume-average particle diameter is 180 nm.

—Production of Resin Particles Dispersion Liquid 13—

A resin particles dispersion liquid 13 is produced according to the same method as that for the resin particles dispersion liquid 1 except that the resin 2 is 11 parts by mass and the resin 3 is 39 parts by mass. Its volume-average particle diameter is 180 nm.

—Production of Resin Particles Dispersion Liquid 14—

A resin particles dispersion liquid 14 is produced according to the same method as that for the resin particles dispersion liquid 1 except that the resin 2 is 14 parts by mass and the resin 3 is 36 parts by mass. Its volume-average particle diameter is 180 nm.

—Production of Resin Particles Dispersion Liquid 15—

A resin particles dispersion liquid 15 is produced according to the same method as that for the resin particles dispersion liquid 1 except that the resin 1 is 50 parts by mass but the resin 3 is not used. Its volume-average particle diameter is 180 nm.

—Production of Resin Particles Dispersion Liquid 16—

A resin particles dispersion liquid 16 is produced according to the same method as that for the resin particles dispersion liquid 1 except that the resin 3 is 50 parts by mass but the resin 1 is not used. Its volume-average particle diameter is 180 nm.

—Production of Resin Particles Dispersion Liquid 17—

| | |
|---|---|
| Resin 1 | 139.2 parts by mass |
| Styrene | 296 parts by mass |
| n-butyl acrylate | 104 parts by mass |
| Acrylic acid | 6 parts by mass |
| n-dodecylmercaptan | 10 parts by mass |
| Divinyl adipate | 1.6 parts by mass |

A mixture prepared by mixing the above components is added to a solution prepared by dissolving 8 parts by mass of an anionic surfactant (Neogen SC, by Dai-ichi Kogyo Seiyaku) in 550 parts by mass of ion-exchanged water, and dispersed and emulsified therein in a flask, and while this is gradually mixed for 10 minutes, 61 parts by mass of ion-exchanged water dissolving 8 parts by mass of ammonium persulfate (by Wako Pure Chemical) is put thereinto, and purged with nitrogen at a rate of 0.1 liter/min for 20 minutes.

Subsequently, with stirring therein, the flask is heated in an oil bath until the content therein could reach 70° C., then the emulsion polymerization is kept continued as such for 5 hours. After cooled, 2234 parts by mass of ion-exchanged water is added thereto to produce a resin particles dispersion liquid 17. Its volume-average particle diameter is 240 nm.

(Preparation of Pigment Dispersion Liquid)

—Preparation of Pigment Dispersion Liquid 1—

| | |
|---|---|
| C.I. Pigment Blue 15:3 (phthalocyanine pigment, Dainichi Seika's Cyanine Blue 4937) | 50 parts by mass |
| Anionic surfactant Neogen SC (by Dai-ichi Kogyo Seiyaku) | 5 parts by mass |
| Ion-exchanged water | 200 parts by mass |

The above components are mixed and dissolved, and dispersed with a homogenizer (IKA's Ultratalax) for 10 minutes, thereby giving a pigment dispersion liquid 1 having a median particle diameter of 175 nm.

—Preparation of Pigment Dispersion Liquid 2—

A pigment dispersion liquid 2 is prepared according to the same method as that for the pigment dispersion liquid 1 except that the pigment is changed to C.I. Pigment Yellow 74 (Dainichi Seika's Seika Fast Yellow 2054). Its median particle diameter is 180 nm.

—Preparation of Pigment Dispersion Liquid 3—

A pigment dispersion liquid 3 is prepared according to the same method as that for the pigment dispersion liquid 1 except that the pigment is changed to C.I. Pigment Yellow 17 (disazo pigment, Dies KET Yellow 403). Its median particle diameter is 190 nm.

—Preparation of Pigment Dispersion Liquid 4—

A pigment dispersion liquid 4 is prepared according to the same method as that for the pigment dispersion liquid 1 except that the pigment is changed to C.I. Pigment Red 122 (quinacridone pigment, Dainichi Seika's Seika Chromofine Magenta). Its median particle diameter is 180 nm.

(Preparation of Release Agent Dispersion Liquid)

| | |
|---|---|
| Paraffin wax (Nippon Seiro's HNP-9) | 25 parts by mass |
| Anionic surfactant Neogen SC (by Dai-ichi Kogyo) | 5 parts by mass |
| Ion-exchanged water | 200 parts by mass |

The above components are heated at 95° C., dispersed with IKA's Ultratalax T50, and further dispersed with a pressure discharge Gaulin homogenizer to give a release agent dispersion liquid having a median diameter of 200 nm.

(Production of Toner Particles)

—Production of Toner Particles 1—

| | |
|---|---|
| Resin particles dispersion liquid 1 | 500 parts by mass |
| Pigment dispersion liquid 2 | 20 parts by mass |
| Release agent dispersion liquid | 70 parts by mass |
| Aqueous 10 wt. % polyaluminium chloride solution (by Asada Chemical) | 0.8 parts by mass |
| Aqueous 10 wt. % ammonium sulfate solution (by Asada Chemical) | 1.0 part by mass |
| Aqueous 10 wt. % aluminium sulfate solution (by Asada Chemical) | 1.2 parts by mass |

The above components are mixed and dispersed in a round stainless flask, using a homogenizer (IKA's Ultratalax T50), then heated up to 45° C. with stirring the contents in the flask, and kept at 45° C. for 30 minutes.

The resin particles dispersion liquid 1 (20 parts by mass) is added to the mixture, and kept at a temperature of 48° C. for 30 minutes. Further, the resin particles dispersion liquid 1 (20 parts by mass) is added thereto and kept at a temperature of 49° C. for 30 minutes. The resulting contents are observed with an optical microscope, and the formation of aggregated particles having a particle diameter of about 5.5 μm is confirmed. An aqueous sodium hydroxide solution is added thereto for pH control to 8. Subsequently, this is heated up to 90° C., and then the aggregated particles are fused, taking about 1 hour. After cooled, this is filtered, fully washed with ion-exchanged water and dried to give toner particles 1.

—Production of Toner Particles 2—

Toner particles 2 are produced according to the same method as that for the toner particles 1 except that the resin particles dispersion liquid 2 is used.

—Production of Toner Particles 3—

Toner particles 3 are produced according to the same method as that for the toner particles 1 except that the resin particles dispersion liquid 3 is used.

—Production of Toner Particles 4—

Toner particles 4 are produced according to the same method as that for the toner particles 1 except that the resin particles dispersion liquid 4 is used.

—Production of Toner Particles 5—

Toner particles 5 are produced according to the same method as that for the toner particles 1 except that the resin particles dispersion liquid 5 is used.

—Production of Toner Particles 6—

Toner particles 6 are produced according to the same method as that for the toner particles 1 except that the resin particles dispersion liquid 6 is used.

—Production of Toner Particles 7—

Toner particles 7 are produced according to the same method as that for the toner particles 1 except that the resin particles dispersion liquid 7 is used.

—Production of Toner Particles 8—

Toner particles 8 are produced according to the same method as that for the toner particles 1 except that the resin particles dispersion liquid 8 is used.

—Production of Toner Particles 9—

Toner particles 9 are produced according to the same method as that for the toner particles 1 except that the resin particles dispersion liquid 9 is used.

—Production of Toner Particles 10—

Toner particles 10 are produced according to the same method as that for the toner particles 1 except that the resin particles dispersion liquid 10 is used.

—Production of Toner Particles 11—

Toner particles 11 are produced according to the same method as that for the toner particles 1 except that the resin particles dispersion liquid 11 is used.

—Production of Toner Particles 12—

Toner particles 12 are produced according to the same method as that for the toner particles 1 except that the resin particles dispersion liquid 12 is used.

—Production of Toner Particles 13—

Toner particles 13 are produced according to the same method as that for the toner particles 1 except that the resin particles dispersion liquid 13 is used.

—Production of Toner Particles 14—

Toner particles 14 are produced according to the same method as that for the toner particles 1 except that the resin particles dispersion liquid 14 is used.

—Production of Toner Particles 15—

Toner particles 15 are produced according to the same method as that for the toner particles 6 except that the coloring agent dispersion liquid 1 is used.

—Production of Toner Particles 16—

Toner particles 16 are produced according to the same method as that for the toner particles 6 except that the coloring agent dispersion liquid 3 is used.

—Production of Toner Particles 17—

Toner particles 17 are produced according to the same method as that for the toner particles 6 except that the coloring agent dispersion liquid 4 is used.

—Production of Toner Particles 18—

Toner particles 18 are produced according to the same method as that for the toner particles 1 except that the resin particles dispersion liquid 17 is used.

—Production of Toner Particles 19—

Toner particles 19 are produced according to the same method as that for the toner particles 6 except that the resin particles dispersion liquid 1 (500 parts by mass) is changed to the resin particles dispersion liquid 15 (110 parts by mass) and the resin particles dispersion liquid 16 (390 parts by mass).

—Production of Toner Particles 20—

220 parts by mass of the resin 1, 780 parts by mass of the resin 3, 50 parts by mass of C.I. Pigment Yellow 74, and 90 parts by mass of paraffin wax are melt-kneaded in a Banbury mixer, cooled, roughly ground, finely ground with a jet pulverizer, and classified with an elbow jet classifier (by Matsubo) to give toner particles 20 having a mean particle diameter of 7.0 μm.

(Production of Toners 1 to 20)

To the toner particles 1 to 20 produced in the manner as above, 1.5 parts by mass of silica (Nippon Aerosil's R972) is added based on 100 parts by mass of the toner particles, and mixed with a Henschel mixer (at a circumferential speed at the tip thereof of 30 msec for 1 minute) to produce toners 1 to 20.

<Carrier>

(Preparation of Resin for Forming Resin Coating Layer)

—Preparation of Resin A for Forming Resin Coating Layer—

| | |
|---|---|
| Cyclohexyl methacrylate | 1000 parts by mass |
| Toluene | 1000 parts by mass |
| Azobisisobutyronitrile | 20 parts by mass |

The above materials are heated at 65° C. and stirred for 8 hours for polymerization. The resulting polymer is dissolved in methyl ethyl ketone and precipitated with hexane in an amount of 7 times the solvent, thereby preparing a polycyclohexyl methacrylate resin. This is ground with a hammer mill and pulverized with a jet mill to give a resin A for forming resin coating layer.

The glass transition temperature of the resin A for forming resin coating layer is 56° C.

—Preparation of Resin B for Forming Resin Coating Layer—

MP-1451 (polymethyl methacrylate: 150 nm, by Soken Chemical) is directly used as it is for a resin B for forming resin coating layer.

The glass transition temperature of the resin B for forming resin coating layer is 105° C.

—Preparation of Resin C for Forming Resin Coating Layer—

A resin C for forming resin coating layer is prepared in the same manner as that for the resin A for forming resin coating layer except that 1000 parts by mass of cyclohexyl methacrylate used in the preparation of the resin A is changed to 400 parts by mass of cyclohexyl methacrylate and 600 parts by mass of methyl methacrylate.

The glass transition temperature of the resin C for forming resin coating layer is 84° C.

(Production of Carrier)

—Production of Carrier 1—

500 parts by mass of ferrite particles (trade name, EF35B by Powder-Tech, mean particle diameter 35 μm) as core particles, and 12 parts by mass of the resin A for forming resin coating layer are put into Nobilta (by Hosokawa Micron), and stirred at 1,000 rpm for 7 minutes whereby the resin A is adhered to the particles by mechanical shock given thereto. Further, this is sieved through a 75-1 μm sieve to give a carrier 1. The ratio of the exposed area of the core particle to the surface of the carrier is 7.2%.

—Production of Carrier 2—

500 parts by mass of ferrite particles (trade name, EF35B by Powder-Tech, mean particle diameter 35 μm) as core particles, and 12 parts by mass of the resin A for forming resin coating layer are processed with a sample mill at 800 rpm at 66° C. for 2 minutes, then put into Nobilta (by Hosokawa Micron), and stirred at 1,500 rpm for 7 minutes whereby the resin A is adhered to the particles by mechanical shock given thereto. Further, this is sieved through a 75-μm sieve to give a carrier 2. The ratio of the exposed area of the core particle to the surface of the carrier is 6.8%.

—Production of Carrier 3—

A carrier 3 is produced according to the same method as that for the carrier 2 except that, in the production of the carrier 2, the resin A for forming resin coating layer is 14 parts by mass and the temperature of the sample mill is 68° C. The ratio of the exposed area of the core particle to the surface of the carrier is 5.2%.

—Production of Carrier 4—

A carrier 4 is produced according to the same method as that for the carrier 2 except that, in the production of the carrier 2, the resin A for forming resin coating layer is 14 parts by mass and the temperature of the sample mill is 70° C. The ratio of the exposed area of the core particle to the surface of the carrier is 4.8%.

—Production of Carrier 5—

A carrier 5 is produced according to the same method as that for the carrier 2 except that, in the production of the carrier 2, the resin A for forming resin coating layer is 16 parts by mass and the temperature of the sample mill is 73° C., the revolution speed is 1000 revolution per minute (rpm). The ratio of the exposed area of the core particle to the surface of the carrier is 1.2%.

—Production of Carrier 6—

A carrier 6 is produced according to the same method as that for the carrier 2 except that, in the production of the carrier 2, the resin A for forming resin coating layer is 16 parts by mass, the temperature of the sample mill is 73° C., the revolution speed is 1000 rpm and the stirring time is 5 minutes. The ratio of the exposed area of the core particle to the surface of the carrier is 0.8%.

—Production of Carrier 7—

A carrier 7 is produced according to the same method as that for the carrier 6 except that, in the production of the carrier 6, the resin A for forming resin coating layer is changed to the resin B for forming resin coating layer and the temperature of the sample mill is 118° C. The ratio of the exposed area of the core particle to the surface of the carrier is 0.8%.

—Production of Carrier 8—

A carrier 8 is produced according to the same method as that for the carrier 6 except that, in the production of the carrier 6, the resin A for forming resin coating layer is changed to the resin C for forming resin coating layer and the temperature of the sample mill is 95° C. The ratio of the exposed area of the core particle to the surface of the carrier is 0.8%.

<Preparation of Developing Device 1>

The developing device is taken out of Fuji Xerox's Apeos Port-II C4300, in which the distance between the control member and the developer holding member is controlled to be 0.19 mm. This is a developing device 1.

<Preparation of Developing Device 2>

A developing device 2 is prepared in the same manner as that for the developing device 1 except that the spacing distance between the control member and the developer holding member is controlled to be 0.21 mm.

<Preparation of Developing Device 3>

A developing device 3 is prepared in the same manner as that for the developing device 1 except that the spacing distance between the control member and the developer holding member is controlled to be 0.39 mm.

<Preparation of Developing Device 4>

A developing device 4 is prepared in the same manner as that for the developing device 1 except that the spacing distance between the control member and the developer holding member is controlled to be 0.41 mm.

<Preparation of Developing Device 5>

A developing device 5 is prepared in the same manner as that for the developing device 1 except that the spacing distance between the control member and the developer holding member is controlled to be 0.69 mm.

<Preparation of Developing Device 6>

A developing device 6 is prepared in the same manner as that for the developing device 1 except that the spacing distance between the control member and the developer holding member is controlled to be 0.71 mm.

<Preparation of Developing Device 7>

A developing device 7 is prepared in the same manner as that for the developing device 1 except that the spacing distance between the control member and the developer holding member is controlled to be 0.79 mm.

<Preparation of Developing Device 8>

A developing device 8 is prepared in the same manner as that for the developing device 1 except that the spacing distance between the control member and the developer holding member is controlled to be 0.81 mm.

Example 1

The toner 6 (6 parts by mass) and the carrier 6 (92 parts by mass) are put into a V-shaped blender and stirred at 20 rpm for 15 minutes to produce a developer. This is put in the developing device 4 and evaluated. The result is shown in Table 1.

<Evaluation 1 (image density)>

The developing device 4 is installed in a modified machine of Fuji Xerox's Apeos Port-II C4300 (this is so modified that the developing device 1 to 8 can be driven for image outputting in the absence of any other developing device therein), in which an A3-size white paper with no image drawn thereon is led to run through the machine for a total of 10000 sheets. After 10000 sheets, a gradation image paper (test chart of the Society of Electrophotography of Japan, No. 4 1986) is outputted, and the printed image and the original image are visually compared with each other at the part of the original image having the lowest image density.

This is one cycle, and at most 10 cycles are repeated.

The reason of "at most" 10 cycles is in order that, at the time when the difference between the printed image and the original image has become clear according to the evaluation criteria mentioned below, the test for evaluation is not continued further more; and those with no problem after 10 cycles are not tested for evaluation further more.

The level of G2 and more is no problem.

G7: No difference is confirmed in the image density between the original image and the printed image after 100000 sheets.

G6: After 100000 sheets, the image density of the printed image is recognized to be lower than that of the original image.

G5: After 90000 sheets, the image density of the printed image is recognized to be lower than that of the original image.

G4: After 80000 sheets, the image density of the printed image is recognized to be lower than that of the original image.

G3: After 70000 sheets, the image density of the printed image is recognized to be lower than that of the original image.

G2: After 60000 sheets, the image density of the printed image is recognized to be lower than that of the original image.

G1: After 50000 sheets, the image density of the printed image is recognized to be lower than that of the original image.

<Evaluation 2 (Toner Cracking)>

GSDp of the toner separated from the developer in the initial state in Evaluation 1 (this is referred to as GSDp1) and the GSDp of the toner separated from the developer after the test of Evaluation 1 (this is referred to as GSDp2) are measured, and the toner cracking resistance is evaluated from the ratio "GSDp2/GSDp1".

The samples with GSDp2/GSDp of 1.18 or less are no problem; and those with the ratio nearer to 1 are better.

The toner is separated from the developer by putting the developer in an aqueous solution of the same surfactant as that used in dispersing the toner particles in the method of measuring the volume-average particle size of the toner particles and the toner, as described above.

Examples 2 to 32, Comparative Examples 1 and 2

Developers, for which the combination of the toner and the carrier is shown in Table 1, are produced according to the same method as in Example 1, and using the developing device 4, the developers are evaluated in the same manner as in Example 1. The results are shown in Table 1.

Examples 33 to 64, Comparative Examples 3 and 4

Developers, for which the combination of the toner and the carrier is shown in Table 2, are produced, and using the developing device 5, the developers are evaluated in the same manner as in Example 1. The results are shown in Table 2.

Examples 65 to 96, Comparative Examples 5 and 6

Developers, for which the combination of the toner and the carrier is shown in Table 3, are produced, and using the developing device 3, the developers are evaluated in the same manner as in Example 1. The results are shown in Table 3.

Examples 97 to 128, Comparative Examples 7 and 8

Developers, for which the combination of the toner and the carrier is shown in Table 4, are produced, and using the developing device 6, the developers are evaluated in the same manner as in Example 1. The results are shown in Table 4.

Examples 129 to 160, Comparative Examples 9 and 10

Developers, for which the combination of the toner and the carrier is shown in Table 5, are produced, and using the developing device 2, the developers are evaluated in the same manner as in Example 1. The results are shown in Table 5.

Examples 161 to 192, Comparative Examples 11 and 12

Developers, for which the combination of the toner and the carrier is shown in Table 6, are produced, and using the developing device 7, the developers are evaluated in the same manner as in Example 1. The results are shown in Table 6.

Examples 193 to 224, Comparative Examples 13 and 14

Developers, for which the combination of the toner and the carrier is shown in Table 7, are produced, and using the developing device 1, the developers are evaluated in the same manner as in Example 1. The results are shown in Table 7.

Examples 225 to 256, Comparative Examples 15 and 16

Developers, for which the combination of the toner and the carrier is shown in Table 8, are produced, and using the developing device 8, the developers are evaluated in the same manner as in Example 1. The results are shown in Table 8.

TABLE 1

Examples with Developing Device 4

| | Toner | Carrier | Image Density | Toner Cracking |
|---|---|---|---|---|
| Example 1 | Toner 6 | Carrier 6 | G7 | 1.05 |
| Example 2 | Toner 7 | Carrier 6 | G7 | 1.05 |
| Example 3 | Toner 8 | Carrier 6 | G6 | 1.06 |
| Example 4 | Toner 9 | Carrier 6 | G6 | 1.06 |
| Example 5 | Toner 4 | Carrier 6 | G6 | 1.06 |
| Example 6 | Toner 5 | Carrier 6 | G6 | 1.05 |
| Example 7 | Toner 6 | Carrier 5 | G6 | 1.06 |
| Example 8 | Toner 7 | Carrier 5 | G6 | 1.06 |
| Example 9 | Toner 4 | Carrier 4 | G6 | 1.06 |
| Example 10 | Toner 9 | Carrier 4 | G6 | 1.06 |
| Example 11 | Toner 3 | Carrier 4 | G5 | 1.08 |
| Example 12 | Toner 10 | Carrier 4 | G5 | 1.08 |
| Example 13 | Toner 4 | Carrier 3 | G5 | 1.08 |
| Example 14 | Toner 9 | Carrier 3 | G5 | 1.09 |
| Example 15 | Toner 2 | Carrier 2 | G5 | 1.08 |
| Example 16 | Toner 11 | Carrier 2 | G5 | 1.08 |
| Example 17 | Toner 1 | Carrier 2 | G4 | 1.10 |
| Example 18 | Toner 12 | Carrier 2 | G4 | 1.11 |
| Example 19 | Toner 13 | Carrier 6 | G6 | 1.05 |
| Example 20 | Toner 14 | Carrier 6 | G6 | 1.06 |
| Example 21 | Toner 13 | Carrier 2 | G4 | 1.10 |
| Example 22 | Toner 14 | Carrier 2 | G4 | 1.10 |
| Example 23 | Toner 15 | Carrier 6 | G6 | 1.06 |
| Example 24 | Toner 16 | Carrier 6 | G6 | 1.06 |
| Example 25 | Toner 17 | Carrier 6 | G6 | 1.06 |
| Example 26 | Toner 16 | Carrier 2 | G4 | 1.10 |
| Example 27 | Toner 18 | Carrier 6 | G6 | 1.06 |
| Example 28 | Toner 18 | Carrier 2 | G4 | 1.11 |
| Example 29 | Toner 19 | Carrier 6 | G6 | 1.06 |
| Example 30 | Toner 19 | Carrier 2 | G4 | 1.11 |
| Example 31 | Toner 6 | Carrier 7 | G6 | 1.06 |
| Example 32 | Toner 6 | Carrier 8 | G7 | 1.05 |
| Comparative Example 1 | Toner 6 | Carrier 1 | G1 | 1.21 |
| Comparative Example 2 | Toner 20 | Carrier 6 | G1 | 1.21 |

TABLE 2

| Examples with Developing Device 5 | | | | |
|---|---|---|---|---|
| | Toner | Carrier | Image Density | Toner Cracking |
| Example 33 | Toner 6 | Carrier 6 | G7 | 1.05 |
| Example 34 | Toner 7 | Carrier 6 | G7 | 1.05 |
| Example 35 | Toner 8 | Carrier 6 | G6 | 1.05 |
| Example 36 | Toner 9 | Carrier 6 | G6 | 1.06 |
| Example 37 | Toner 4 | Carrier 6 | G6 | 1.06 |
| Example 38 | Toner 5 | Carrier 6 | G6 | 1.05 |
| Example 39 | Toner 6 | Carrier 5 | G6 | 1.06 |
| Example 40 | Toner 7 | Carrier 5 | G6 | 1.06 |
| Example 41 | Toner 4 | Carrier 4 | G6 | 1.06 |
| Example 42 | Toner 9 | Carrier 4 | G6 | 1.06 |
| Example 43 | Toner 3 | Carrier 4 | G5 | 1.07 |
| Example 44 | Toner 10 | Carrier 4 | G5 | 1.08 |
| Example 45 | Toner 4 | Carrier 3 | G5 | 1.08 |
| Example 46 | Toner 9 | Carrier 3 | G5 | 1.09 |
| Example 47 | Toner 2 | Carrier 2 | G5 | 1.08 |
| Example 48 | Toner 11 | Carrier 2 | G5 | 1.08 |
| Example 49 | Toner 1 | Carrier 2 | G4 | 1.10 |
| Example 50 | Toner 12 | Carrier 2 | G4 | 1.11 |
| Example 51 | Toner 13 | Carrier 6 | G6 | 1.05 |
| Example 52 | Toner 14 | Carrier 6 | G6 | 1.06 |
| Example 53 | Toner 13 | Carrier 2 | G4 | 1.10 |
| Example 54 | Toner 14 | Carrier 2 | G4 | 1.10 |
| Example 55 | Toner 15 | Carrier 6 | G6 | 1.06 |
| Example 56 | Toner 16 | Carrier 6 | G6 | 1.06 |
| Example 57 | Toner 17 | Carrier 6 | G6 | 1.06 |
| Example 58 | Toner 16 | Carrier 2 | G4 | 1.10 |
| Example 59 | Toner 18 | Carrier 6 | G6 | 1.06 |
| Example 60 | Toner 18 | Carrier 2 | G4 | 1.11 |
| Example 61 | Toner 19 | Carrier 6 | G6 | 1.06 |
| Example 62 | Toner 19 | Carrier 2 | G4 | 1.11 |
| Example 63 | Toner 6 | Carrier 7 | G6 | 1.06 |
| Example 64 | Toner 6 | Carrier 8 | G7 | 1.05 |
| Comparative Example 3 | Toner 6 | Carrier 1 | G1 | 1.2 |
| Comparative Example 4 | Toner 20 | Carrier 6 | G1 | 1.21 |

TABLE 3

| Examples with Developing Device 3 | | | | |
|---|---|---|---|---|
| | Toner | Carrier | Image Density | Toner Cracking |
| Example 65 | Toner 6 | Carrier 6 | G6 | 1.07 |
| Example 66 | Toner 7 | Carrier 6 | G6 | 1.07 |
| Example 67 | Toner 8 | Carrier 6 | G5 | 1.08 |
| Example 68 | Toner 9 | Carrier 6 | G5 | 1.08 |
| Example 69 | Toner 4 | Carrier 6 | G5 | 1.09 |
| Example 70 | Toner 5 | Carrier 6 | G5 | 1.09 |
| Example 71 | Toner 6 | Carrier 5 | G5 | 1.08 |
| Example 72 | Toner 7 | Carrier 5 | G5 | 1.08 |
| Example 73 | Toner 4 | Carrier 4 | G5 | 1.09 |
| Example 74 | Toner 9 | Carrier 4 | G5 | 1.08 |
| Example 75 | Toner 3 | Carrier 4 | G4 | 1.11 |
| Example 76 | Toner 10 | Carrier 4 | G4 | 1.11 |
| Example 77 | Toner 4 | Carrier 3 | G4 | 1.10 |
| Example 78 | Toner 9 | Carrier 3 | G4 | 1.11 |
| Example 79 | Toner 2 | Carrier 2 | G4 | 1.11 |
| Example 80 | Toner 11 | Carrier 2 | G4 | 1.12 |
| Example 81 | Toner 1 | Carrier 2 | G3 | 1.14 |
| Example 82 | Toner 12 | Carrier 2 | G3 | 1.14 |
| Example 83 | Toner 13 | Carrier 6 | G5 | 1.07 |
| Example 84 | Toner 14 | Carrier 6 | G5 | 1.08 |
| Example 85 | Toner 13 | Carrier 2 | G3 | 1.15 |
| Example 86 | Toner 14 | Carrier 2 | G3 | 1.14 |
| Example 87 | Toner 15 | Carrier 6 | G5 | 1.08 |
| Example 88 | Toner 16 | Carrier 6 | G5 | 1.08 |
| Example 89 | Toner 17 | Carrier 6 | G5 | 1.08 |
| Example 90 | Toner 16 | Carrier 2 | G3 | 1.15 |
| Example 91 | Toner 18 | Carrier 6 | G5 | 1.08 |
| Example 92 | Toner 18 | Carrier 2 | G3 | 1.14 |

TABLE 3-continued

| Examples with Developing Device 3 | | | | |
|---|---|---|---|---|
| | Toner | Carrier | Image Density | Toner Cracking |
| Example 93 | Toner 19 | Carrier 6 | G5 | 1.07 |
| Example 94 | Toner 19 | Carrier 2 | G3 | 1.15 |
| Example 95 | Toner 6 | Carrier 7 | G5 | 1.09 |
| Example 96 | Toner 6 | Carrier 8 | G6 | 1.07 |
| Comparative Example 5 | Toner 6 | Carrier 1 | G1 | 1.22 |
| Comparative Example 6 | Toner 20 | Carrier 6 | G1 | 1.21 |

TABLE 4

| Examples with Developing Device 6 | | | | |
|---|---|---|---|---|
| | Toner | Carrier | Image Density | Toner Cracking |
| Example 97 | Toner 6 | Carrier 6 | G6 | 1.05 |
| Example 98 | Toner 7 | Carrier 6 | G6 | 1.05 |
| Example 99 | Toner 8 | Carrier 6 | G5 | 1.06 |
| Example 100 | Toner 9 | Carrier 6 | G5 | 1.06 |
| Example 101 | Toner 4 | Carrier 6 | G5 | 1.06 |
| Example 102 | Toner 5 | Carrier 6 | G5 | 1.05 |
| Example 103 | Toner 6 | Carrier 5 | G5 | 1.06 |
| Example 104 | Toner 7 | Carrier 5 | G5 | 1.06 |
| Example 105 | Toner 4 | Carrier 4 | G5 | 1.06 |
| Example 106 | Toner 9 | Carrier 4 | G5 | 1.06 |
| Example 107 | Toner 3 | Carrier 4 | G4 | 1.07 |
| Example 108 | Toner 10 | Carrier 4 | G4 | 1.07 |
| Example 109 | Toner 4 | Carrier 3 | G4 | 1.08 |
| Example 110 | Toner 9 | Carrier 3 | G4 | 1.09 |
| Example 111 | Toner 2 | Carrier 2 | G4 | 1.08 |
| Example 112 | Toner 11 | Carrier 2 | G4 | 1.08 |
| Example 113 | Toner 1 | Carrier 2 | G3 | 1.10 |
| Example 114 | Toner 12 | Carrier 2 | G3 | 1.10 |
| Example 115 | Toner 13 | Carrier 6 | G5 | 1.05 |
| Example 116 | Toner 14 | Carrier 6 | G5 | 1.06 |
| Example 117 | Toner 13 | Carrier 2 | G3 | 1.10 |
| Example 118 | Toner 14 | Carrier 2 | G3 | 1.10 |
| Example 119 | Toner 15 | Carrier 6 | G5 | 1.06 |
| Example 120 | Toner 16 | Carrier 6 | G5 | 1.06 |
| Example 121 | Toner 17 | Carrier 6 | G5 | 1.06 |
| Example 122 | Toner 16 | Carrier 2 | G3 | 1.10 |
| Example 123 | Toner 18 | Carrier 6 | G5 | 1.06 |
| Example 124 | Toner 18 | Carrier 2 | G3 | 1.10 |
| Example 125 | Toner 19 | Carrier 6 | G5 | 1.06 |
| Example 126 | Toner 19 | Carrier 2 | G3 | 1.11 |
| Example 127 | Toner 6 | Carrier 7 | G5 | 1.06 |
| Example 128 | Toner 6 | Carrier 8 | G6 | 1.05 |
| Comparative Example 7 | Toner 6 | Carrier 1 | G1 | 1.20 |
| Comparative Example 8 | Toner 20 | Carrier 6 | G1 | 1.20 |

TABLE 5

| Examples with Developing Device 2 | | | | |
|---|---|---|---|---|
| | Toner | Carrier | Image Density | Toner Cracking |
| Example 129 | Toner 6 | Carrier 6 | G5 | 1.07 |
| Example 130 | Toner 7 | Carrier 6 | G5 | 1.07 |
| Example 131 | Toner 8 | Carrier 6 | G4 | 1.10 |
| Example 132 | Toner 9 | Carrier 6 | G4 | 1.11 |
| Example 133 | Toner 4 | Carrier 6 | G4 | 1.10 |
| Example 134 | Toner 5 | Carrier 6 | G4 | 1.10 |
| Example 135 | Toner 6 | Carrier 5 | G4 | 1.11 |
| Example 136 | Toner 7 | Carrier 5 | G4 | 1.11 |
| Example 137 | Toner 4 | Carrier 4 | G4 | 1.10 |
| Example 138 | Toner 9 | Carrier 4 | G4 | 1.10 |
| Example 139 | Toner 3 | Carrier 4 | G3 | 1.14 |

TABLE 5-continued

| Examples with Developing Device 2 | | | | |
|---|---|---|---|---|
| | Toner | Carrier | Image Density | Toner Cracking |
| Example 140 | Toner 10 | Carrier 4 | G3 | 1.15 |
| Example 141 | Toner 4 | Carrier 3 | G3 | 1.14 |
| Example 142 | Toner 9 | Carrier 3 | G3 | 1.14 |
| Example 143 | Toner 2 | Carrier 2 | G3 | 1.14 |
| Example 144 | Toner 11 | Carrier 2 | G3 | 1.14 |
| Example 145 | Toner 1 | Carrier 2 | G2 | 1.17 |
| Example 146 | Toner 12 | Carrier 2 | G2 | 1.17 |
| Example 147 | Toner 13 | Carrier 6 | G4 | 1.11 |
| Example 148 | Toner 14 | Carrier 6 | G4 | 1.10 |
| Example 149 | Toner 13 | Carrier 2 | G2 | 1.16 |
| Example 150 | Toner 14 | Carrier 2 | G2 | 1.17 |
| Example 151 | Toner 15 | Carrier 6 | G4 | 1.11 |
| Example 152 | Toner 16 | Carrier 6 | G4 | 1.10 |
| Example 153 | Toner 17 | Carrier 6 | G4 | 1.11 |
| Example 154 | Toner 16 | Carrier 2 | G2 | 1.16 |
| Example 155 | Toner 18 | Carrier 6 | G4 | 1.10 |
| Example 156 | Toner 18 | Carrier 2 | G2 | 1.16 |
| Example 157 | Toner 19 | Carrier 6 | G4 | 1.11 |
| Example 158 | Toner 19 | Carrier 2 | G2 | 1.16 |
| Example 159 | Toner 6 | Carrier 7 | G4 | 1.10 |
| Example 160 | Toner 6 | Carrier 8 | G5 | 1.09 |
| Comparative Example 9 | Toner 6 | Carrier 1 | G1 | 1.21 |
| Comparative Example 10 | Toner 20 | Carrier 6 | G1 | 1.21 |

TABLE 6

| Examples with Developing Device 7 | | | | |
|---|---|---|---|---|
| | Toner | Carrier | Image Density | Toner Cracking |
| Example 161 | Toner 6 | Carrier 6 | G5 | 1.05 |
| Example 162 | Toner 7 | Carrier 6 | G5 | 1.05 |
| Example 163 | Toner 8 | Carrier 6 | G4 | 1.06 |
| Example 164 | Toner 9 | Carrier 6 | G4 | 1.06 |
| Example 165 | Toner 4 | Carrier 6 | G4 | 1.06 |
| Example 166 | Toner 5 | Carrier 6 | G4 | 1.05 |
| Example 167 | Toner 6 | Carrier 5 | G4 | 1.06 |
| Example 168 | Toner 7 | Carrier 5 | G4 | 1.06 |
| Example 169 | Toner 4 | Carrier 4 | G4 | 1.06 |
| Example 170 | Toner 9 | Carrier 4 | G4 | 1.06 |
| Example 171 | Toner 3 | Carrier 4 | G3 | 1.07 |
| Example 172 | Toner 10 | Carrier 4 | G3 | 1.07 |
| Example 173 | Toner 4 | Carrier 3 | G3 | 1.08 |
| Example 174 | Toner 9 | Carrier 3 | G3 | 1.09 |
| Example 175 | Toner 2 | Carrier 2 | G3 | 1.08 |
| Example 176 | Toner 11 | Carrier 2 | G3 | 1.08 |
| Example 177 | Toner 1 | Carrier 2 | G2 | 1.10 |
| Example 178 | Toner 12 | Carrier 2 | G2 | 1.11 |
| Example 179 | Toner 13 | Carrier 6 | G4 | 1.05 |
| Example 180 | Toner 14 | Carrier 6 | G4 | 1.06 |
| Example 181 | Toner 13 | Carrier 2 | G2 | 1.10 |
| Example 182 | Toner 14 | Carrier 2 | G2 | 1.10 |
| Example 183 | Toner 15 | Carrier 6 | G4 | 1.06 |
| Example 184 | Toner 16 | Carrier 6 | G4 | 1.06 |
| Example 185 | Toner 17 | Carrier 6 | G4 | 1.06 |
| Example 186 | Toner 16 | Carrier 2 | G2 | 1.10 |
| Example 187 | Toner 18 | Carrier 6 | G4 | 1.06 |
| Example 188 | Toner 18 | Carrier 2 | G2 | 1.10 |
| Example 189 | Toner 19 | Carrier 6 | G4 | 1.06 |
| Example 190 | Toner 19 | Carrier 2 | G2 | 1.10 |
| Example 191 | Toner 6 | Carrier 7 | G4 | 1.06 |
| Example 192 | Toner 6 | Carrier 8 | G5 | 1.05 |
| Comparative Example 11 | Toner 6 | Carrier 1 | G1 | 1.20 |
| Comparative Example 12 | Toner 20 | Carrier 6 | G1 | 1.20 |

TABLE 7

| Examples with Developing Device 1 | | | | |
|---|---|---|---|---|
| | Toner | Carrier | Image Density | Toner Cracking |
| Example 193 | Toner 6 | Carrier 6 | G4 | 1.10 |
| Example 194 | Toner 7 | Carrier 6 | G4 | 1.10 |
| Example 195 | Toner 8 | Carrier 6 | G3 | 1.14 |
| Example 196 | Toner 9 | Carrier 6 | G3 | 1.13 |
| Example 197 | Toner 4 | Carrier 6 | G3 | 1.14 |
| Example 198 | Toner 5 | Carrier 6 | G3 | 1.14 |
| Example 199 | Toner 6 | Carrier 5 | G3 | 1.13 |
| Example 200 | Toner 7 | Carrier 5 | G3 | 1.14 |
| Example 201 | Toner 4 | Carrier 4 | G3 | 1.14 |
| Example 202 | Toner 9 | Carrier 4 | G3 | 1.14 |
| Example 203 | Toner 3 | Carrier 4 | G2 | 1.16 |
| Example 204 | Toner 10 | Carrier 4 | G2 | 1.17 |
| Example 205 | Toner 4 | Carrier 3 | G2 | 1.16 |
| Example 206 | Toner 9 | Carrier 3 | G2 | 1.17 |
| Example 207 | Toner 2 | Carrier 2 | G2 | 1.17 |
| Example 208 | Toner 11 | Carrier 2 | G2 | 1.17 |
| Example 209 | Toner 1 | Carrier 2 | G2 | 1.17 |
| Example 210 | Toner 12 | Carrier 2 | G2 | 1.16 |
| Example 211 | Toner 13 | Carrier 6 | G3 | 1.14 |
| Example 212 | Toner 14 | Carrier 6 | G3 | 1.13 |
| Example 213 | Toner 13 | Carrier 2 | G2 | 1.16 |
| Example 214 | Toner 14 | Carrier 2 | G2 | 1.17 |
| Example 215 | Toner 15 | Carrier 6 | G3 | 1.14 |
| Example 216 | Toner 16 | Carrier 6 | G3 | 1.14 |
| Example 217 | Toner 17 | Carrier 6 | G3 | 1.14 |
| Example 218 | Toner 16 | Carrier 2 | G2 | 1.16 |
| Example 219 | Toner 18 | Carrier 6 | G3 | 1.14 |
| Example 220 | Toner 18 | Carrier 2 | G2 | 1.16 |
| Example 221 | Toner 19 | Carrier 6 | G3 | 1.14 |
| Example 222 | Toner 19 | Carrier 2 | G2 | 1.16 |
| Example 223 | Toner 6 | Carrier 7 | G3 | 1.13 |
| Example 224 | Toner 6 | Carrier 8 | G3 | 1.14 |
| Comparative Example 13 | Toner 6 | Carrier 1 | G1 | 1.22 |
| Comparative Example 14 | Toner 20 | Carrier 6 | G1 | 1.22 |

TABLE 8

| Examples with Developing Device 8 | | | | |
|---|---|---|---|---|
| | Toner | Carrier | Image Density | Toner Cracking |
| Example 225 | Toner 6 | Carrier 6 | G4 | 1.05 |
| Example 226 | Toner 7 | Carrier 6 | G4 | 1.05 |
| Example 227 | Toner 8 | Carrier 6 | G3 | 1.05 |
| Example 228 | Toner 9 | Carrier 6 | G3 | 1.06 |
| Example 229 | Toner 4 | Carrier 6 | G3 | 1.06 |
| Example 230 | Toner 5 | Carrier 6 | G3 | 1.05 |
| Example 231 | Toner 6 | Carrier 5 | G3 | 1.05 |
| Example 232 | Toner 7 | Carrier 5 | G3 | 1.06 |
| Example 233 | Toner 4 | Carrier 4 | G3 | 1.06 |
| Example 234 | Toner 9 | Carrier 4 | G3 | 1.06 |
| Example 235 | Toner 3 | Carrier 4 | G2 | 1.08 |
| Example 236 | Toner 10 | Carrier 4 | G2 | 1.08 |
| Example 237 | Toner 4 | Carrier 3 | G2 | 1.08 |
| Example 238 | Toner 9 | Carrier 3 | G2 | 1.08 |
| Example 239 | Toner 2 | Carrier 2 | G2 | 1.08 |
| Example 240 | Toner 11 | Carrier 2 | G2 | 1.07 |
| Example 241 | Toner 1 | Carrier 2 | G2 | 1.10 |
| Example 242 | Toner 12 | Carrier 2 | G2 | 1.10 |
| Example 243 | Toner 13 | Carrier 6 | G3 | 1.05 |
| Example 244 | Toner 14 | Carrier 6 | G3 | 1.06 |
| Example 245 | Toner 13 | Carrier 2 | G2 | 1.10 |
| Example 246 | Toner 14 | Carrier 2 | G2 | 1.10 |
| Example 247 | Toner 15 | Carrier 6 | G3 | 1.06 |
| Example 248 | Toner 16 | Carrier 6 | G3 | 1.06 |
| Example 249 | Toner 17 | Carrier 6 | G3 | 1.06 |
| Example 250 | Toner 16 | Carrier 2 | G2 | 1.10 |
| Example 251 | Toner 18 | Carrier 6 | G3 | 1.06 |
| Example 252 | Toner 18 | Carrier 2 | G2 | 1.11 |

TABLE 8-continued

| Examples with Developing Device 8 | | | | |
|---|---|---|---|---|
| | Toner | Carrier | Image Density | Toner Cracking |
| Example 253 | Toner 19 | Carrier 6 | G3 | 1.06 |
| Example 254 | Toner 19 | Carrier 2 | G2 | 1.10 |
| Example 255 | Toner 6 | Carrier 7 | G3 | 1.06 |
| Example 256 | Toner 6 | Carrier 8 | G4 | 1.05 |
| Comparative Example 15 | Toner 6 | Carrier 1 | G1 | 1.19 |
| Comparative Example 16 | Toner 20 | Carrier 6 | G1 | 1.2 |

From the above results, it is obvious that the image density is prevented from lowering and the toner is prevented from cracking in Examples than in Comparative Examples.

What is claimed is:

1. An electrostatic latent image developer comprising:

an electrostatic-latent-image-developing toner that has toner particles formed by aggregating and fusing resin particles containing a polyester resin and a styrene resin and particles of a coloring agent in a starting material dispersion liquid of those particles dispersed in an aqueous solvent; and a carrier having a core particle and a resin coating layer coating the surface of the core particle, wherein the ratio of the exposed area of the core particle to the surface of the carrier is about 7% or less, and wherein the weight-average molecular weight (Mw) of the polyester resin is from about 12,000 to about 200,000.

2. The electrostatic latent image developer according to claim 1, wherein the glass transition temperature of the polyester resin is from about 30° C. to about 90° C.

3. The electrostatic latent image developer according to claim 1, wherein the total content of the polyester resin and the styrene resin is from about 70% by mass to about 95% by mass, relative to the entire toner particles.

4. The electrostatic latent image developer according to claim 1, wherein the ratio by mass of the polyester resin to the styrene resin (polyester resin/styrene resin) is from about 10/90 to about 50/50.

5. The electrostatic latent image developer according to claim 1, wherein the resin contained in the resin coating layer contains a cycloalkyl (meth)acrylate as the polymerization component thereof.

6. The electrostatic latent image developer according to claim 5, wherein the cycloalkyl (meth)acrylate is cyclohexyl methacrylate.

7. The electrostatic latent image developer according to claim 1, wherein the polyester resin contains bisphenol A as the polymerization component thereof.

8. The electrostatic latent image developer according to claim 1, wherein the coloring agent contains C.I. Pigment Yellow 74.

9. The electrostatic latent image developer according to claim 1, wherein the volume electric resistance (volume resistivity) of the core particle is from about $10^5$ Ω·cm to about $10^{9.5}$ Ω·cm.

10. The electrostatic latent image developer according to claim 1, wherein the mean thickness of the resin coating layer is from about 0.1 μm to about 10 μm.

11. The electrostatic latent image developer according to claim 1, wherein the weight-average molecular weight of the resin contained in the resin coating layer is from about 5,000 to about 1,000,000.

12. The electrostatic latent image developer according to claim 1, wherein the volume electric resistance (at 25° C.) of the carrier is from about $1\times10^7$ Ω·cm to about $1\times10^{15}$ Ω·cm.

* * * * *